US006371846B1

(12) United States Patent
Powell et al.

(10) Patent No.: US 6,371,846 B1
(45) Date of Patent: Apr. 16, 2002

(54) METHOD FOR VENTILATING SECURE FACILITY AND SYSTEM AND APPARATUS USED THEREFOR

(75) Inventors: Robert A. Powell, Frankfort; Richard W. Stephens, Columbia, both of KY (US)

(73) Assignees: Security Products, Inc.; Security Access, Inc., both of Lake Arial, PA (US)

( * ) Notice: Subject to any disclaimer, the term of this patent is extended or adjusted under 35 U.S.C. 154(b) by 0 days.

(21) Appl. No.: 09/573,002

(22) Filed: May 17, 2000

Related U.S. Application Data

(63) Continuation of application No. 09/243,656, filed on Feb. 2, 1999, which is a continuation-in-part of application No. 09/065,004, filed on Apr. 23, 1998, now Pat. No. 5,968,216, which is a continuation-in-part of application No. 09/031,948, filed on Feb. 27, 1998, now Pat. No. 5,976,007.

(51) Int. Cl.[7] ..... F24F 13/28

(52) U.S. Cl. ..... 454/271; 55/385.2; 55/506; 109/1 V

(58) Field of Search ..... 454/48, 254, 271, 454/273, 274; 109/1 V; 55/385.2, 501, 506

(56) References Cited

U.S. PATENT DOCUMENTS

| | | | |
|---|---|---|---|
| 693,638 | A | 2/1902 | Breuer |
| 1,677,421 | A | 7/1928 | Yager et al. |
| 2,575,499 | A | 11/1951 | Manow |
| 3,204,392 | A | 9/1965 | Schwab |
| 3,301,168 | A | 1/1967 | Schindler et al. |
| 3,740,934 | A | 6/1973 | Shuler |
| 4,171,210 | A | 10/1979 | Miller |
| 4,340,937 | A | 7/1982 | Volk, Jr. |
| 4,365,541 | A | 12/1982 | Marques et al. |
| 4,472,184 | A | 9/1984 | Neumann et al. |
| 5,280,273 | A | 1/1994 | Goldstein |
| 5,421,862 | A | 6/1995 | Davis |
| 5,514,036 | A | 5/1996 | Lin |
| 5,679,121 | A | 10/1997 | Kim |

FOREIGN PATENT DOCUMENTS

| | | |
|---|---|---|
| FR | 1330148 | 12/1962 |
| GB | 138782 | 2/1920 |
| GB | 506197 | 5/1939 |

OTHER PUBLICATIONS

Publication, "Trans–aire", Bud Radio, Inc., Cleveland 3, Ohio, 2 pages.

*Primary Examiner*—Harold Joyce
(74) *Attorney, Agent, or Firm*—Baker & Daniels

(57) ABSTRACT

A security vent includes a housing, a drawer and a latch. The housing includes first and second ends defining a passageway in which the drawers receive. The drawer includes a filter receiving slot. The drawer is movable in and out of the passageway to provide access to the filter receiving slot such that a filter can be inserted and removed therefrom. The latch assembly allows the drawer to be locked in a closed position and unlocked for opening. In another embodiment of the invention, a security vent mountable to the existing air duct inlet opening includes a housing assembly having a mounting frame and a housing wall secured to the mounting frame. The housing wall includes a front faced space from the mounting frame. The front face is perforated. The housing wall and mounting frame define a filter receiving region for holding an air filter. A door is secured to the housing wall and may be moved between an open position and a closed position to either permit or prevent access to and from the filter receiving region. The vent further includes a latch assembly for locking the door in a closed position. In another embodiment of the invention, a system for ventilating an enclosed region includes a secure vent affixed to the wall of the region, the vent including a removable filter. An access door is provided and is movable between a closed position and an open position to either permit or prevent access to the filter.

18 Claims, 22 Drawing Sheets

Fig. 28
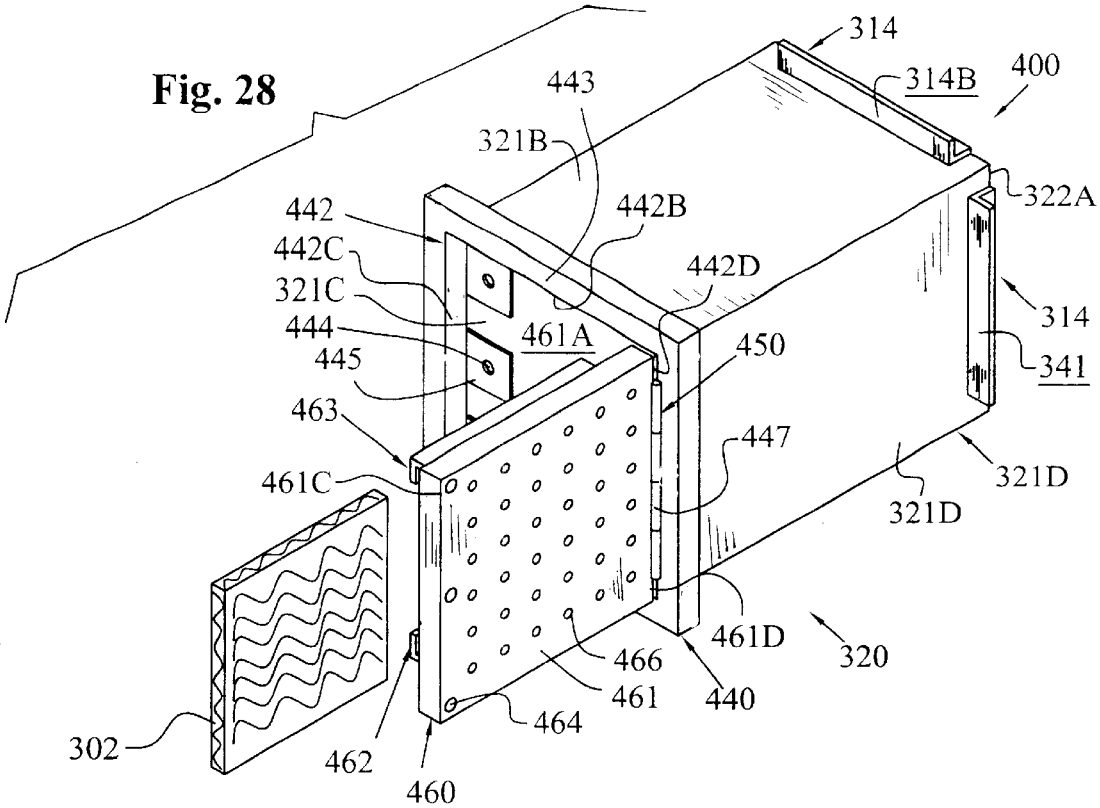
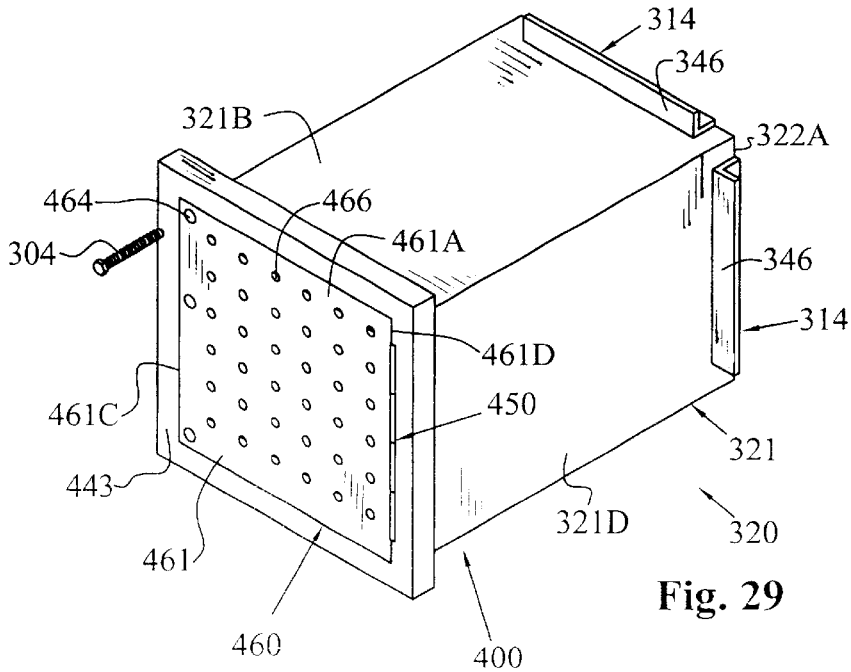
Fig. 29

METHOD FOR VENTILATING SECURE FACILITY AND SYSTEM AND APPARATUS USED THEREFOR

CROSS-REFERENCE TO RELATED APPLICATIONS

The present application is a continuation of U.S. patent application Ser. No. 09/243,656, filed Feb. 2, 1999, which is a continuation-in-part of U.S. patent application Ser. No. 09/065,004, filed Apr. 23, 1998, now U.S. Pat. No. 5,968,216, which is a continuation-in-part of U.S. patent application Ser. No. 09/031,948, filed Feb. 27, 1998, now U.S. Pat. No. 5,976,007. The disclosures of each of the foregoing patents and applications are incorporated herein by reference in their entireties.

BACKGROUND OF THE INVENTION

1. Technical Field of the Invention

The present invention relates to air vents for use in providing ventilation to and from an enclosed region within a building, such as, for example, a room, closet, office, restroom or the like. More particularly, the present invention relates to an air vent for use in providing ventilation to and from an enclosed region within a building, such as, for example, a room, closet, office, restroom or the like, wherein the air vent prevents access to an area exterior to the enclosed region therethrough. The present invention also relates to methods for providing ventilation to and from an enclosed region within a secure facility, such as for providing ventilation to and from an inmate cell within a prison. More particularly, the present invention is for a method for providing ventilation to and from an enclosed region within a secure facility, wherein air being ventilated thereby is filtered by a secure filter unit located near the enclosed region.

2. Description of the Related Art

Office buildings, commercial establishments, industrial plants, educational institutions, residential homes and the like, typically include a plurality of enclosed regions, such as, for example, rooms, closets, offices, restrooms or the like, defined therein for occupancy by office personnel, customers, employees, students, residents or the like. The building and the enclosed regions each require ventilation and exchange of the stale air contained therein with the fresh air exterior to the building existing in the surrounding ambient. Typically, return air, that is, air being removed from the enclosed regions and expelled from the building into the ambient, is pumped from within the enclosed regions and out of the building by a heating, ventilating and air-conditioning ("HVAC") system which typically comprises a series of large fans and a network of inter-connected air ducts connecting the respective enclosed regions of the building to the exterior of the building. With respect to any one enclosed region, the HVAC system can been seen to comprise a supply side and a return side, each side respectively having a fan and a duct which permits air-flow communication between the enclosed region and the ambient.

The supply side typically includes a supply fan which draws fresh air in from the ambient through an intake duct which is open at an inlet end thereof to the outside of the building. Fresh air drawn in through the intake duct is typically not filtered at the intake, except for a screen which is oftentimes provided over the intake inlet end to prevent large debris and wild animals from entering the supply side. The supply side fan pumps the fresh air through a supply side duct to the enclosed region, and then thereinto, through a supply side vent mounted in a wall of the enclosed region. The supply side vent is typically attached to an outlet end of the supply side duct and may include a particulate filter, for example, a high-efficiency particulate arrester ("HEPA") which is typically used to prevent very small particles from entering a so-called "clean room" enclosed region.

The return side typically includes a return side fan, which is oftentimes physically located near the supply side fan, and which draws stale air from the enclosed region, through a return side vent mounted to the side wall of the enclosed region and attached to an inlet end of a return side duct. The stale air is pumped by the return side fan through the return side duct and expelled into the ambient through a discharge duct which is open at an outlet end thereof to the outside of the building. The stale air is typically filtered at the outlet end of the discharge duct to prevent the discharge of air-born particles such as dust, debris, smoke, moisture, human perspiration and the like, into the ambient.

Further, the return air is typically not filtered at the respective inlet ends of the return air ducts, which respectively communicate with the numerous enclosed regions. Because the return air is not filtered prior to entry thereof into the return air duct network, air-born material is permitted to accumulate within the air duct network at various locations throughout, thereby increasing the risk of a so-called "duct fires" therein, as well as decreasing the overall operating efficiency of the HVAC system. It is therefore desirable to provide a method for ventilating an enclosed region within a building, and to provide a system and apparatus used therefor. It is also desirable to provide an air vent for use with an HVAC system of a building. It is also desirable to provide an air vent for use with an HVAC system of a building, wherein the air vent removably receives a filter therein for use in removing air-born particles therefrom. It is furthermore desirable to provide an air vent for use with an HVAC system of a building, wherein the air vent removably receives a filter therein for use in removing air-born particles therefrom, and wherein the air vent is provided at an inlet end of a return air duct.

Similarly, penal institutions, mental hospitals and other secure facilities require ventilation and exchange of the air contained therein, and of the air contained within the cells, rooms and other confined areas therein, with the air exterior thereto existing in the surrounding ambient. However, unlike a non-secure facility, such as an office building, residential home or educational institution, a secure facility must not present an opportunity for a confined individual to escape therefrom, such as, for example, through the HVAC system, or present an opportunity for the confined individual to insert an article of contraband therein, such as, for example, a weapon, drug paraphernalia or the like. Thus, the respective outlet ends of the supply side ducts and the inlet ends of the return air ducts are oftentimes integrally formed with the wall portions which define the respective enclosed regions. A removable air vent is not typically provided at the inlet ends of the return air ducts connected to the wall portions of a secure facility, as this may present an opportunity for a confined individual to remove same and escape from the secure facility or to insert contraband therein. Rather, the wall portion is typically provided with a security screen having a plurality of apertures therethrough through which air from the enclosed region may pass into the return air duct network.

Because the supply side vent, the return side vent and security screen are each typically integrally-formed with the side wall of the enclosed region, access to the supply side duct and to the return side duct from within the enclosed region is prevented thereby. However, because access to the supply side duct and to the return side duct is prevented, neither fresh air entering the enclosed region nor stale air being removed from the enclosed region can be filtered prior to entering or leaving the supply side duct or the return side duct, respectively, as a filter positioned within either the supply side vent or within the return side vent may not be removed and replaced when soiled, if necessary. With respect to the fresh air entering the enclosed region by the supply side vent, the fresh air may be filtered either at the intake or within the supply side air handling unit without any significant negative impact on the quality of the fresh air being discharged into the enclosed region. However, with respect to the stale air being removed from the enclosed region, not filtering the stale air prior to its entering the return side duct oftentimes results in air-born particles, such as dust, debris, smoke, moisture, human perspiration and the like passing through the return side duct and accumulating on the interior surfaces of the return duct, thereby increasing the risk of so-called "duct fires" therein due to the ignition of the accumulated air-born material, as well as decreasing the overall operating efficiency of the HVAC system. It has been further observed that air-born material also accumulates on the security screens, which are neither accessible nor replaceable, thereby decreasing volumetric flow of air from the enclosed regions into the return air duct, decreasing overall ventilation efficiency, decreasing the quality of air being removed from the enclosed regions, and increasing the likelihood of so-called "duct fires" due to ignition of the accumulated air-born material. It is also therefore desirable to provide a method for ventilating an enclosed region within a secure facility, for example, for ventilating an inmate cell within a prison, and to provide a system and apparatus used therefor. It is also therefore desirable to provide an air vent for use with an HVAC system of a building, wherein the air vent provides secure access to an air duct connected thereto. It is furthermore desirable to provide an air vent for use with an HVAC system of a building, wherein the air vent may be installed in the building after the building has been constructed and with a minimum amount of modification to any existing air ducts, vents or the like.

There are no air vents known to Applicants whereby attachment of the air vent to an air duct provides secure access thereto, and wherein a filter is removably received thereby.

SUMMARY OF THE INVENTION

The present invention is for a security vent for use in a secure facility, such as, for example, a penal institution, a mental hospital or the like, or for use in a non-secure facility, such as, for example, an office building, commercial establishment, industrial plant, educational institution, residential home or the like.

It is an object of the present invention to provide an air vent for use with an HVAC system of a building.

It is another object of the present invention to provide an air vent for use with an HVAC system of a building, wherein the air vent removably receives a filter therein for use in removing air-born particles therefrom.

It is yet another object of the present invention to provide an air vent for use with an HVAC system of a building, wherein the air vent removably receives a filter therein for use in removing air-born particles therefrom, and wherein the air vent is provided at an inlet end of a return air duct.

It is still another object of the present invention to provide an air vent for use with an HVAC system of a building, wherein the air vent provides secure access to an air duct connected thereto.

It is yet another object of the present invention to provide an air vent for use with an HVAC system of a building, wherein the air vent may be installed in the building after the building has been constructed and with a minimum amount of modification to any existing air ducts, vents or the like.

It is an object of the present invention to provide a method for ventilating an enclosed region within a building, and to provide a system and apparatus used therefor.

It is another object of the present invention to provide a method for ventilating an enclosed region within a secure facility, for example, for ventilating an inmate cell within a prison, and to provide a system and apparatus used therefor.

It is still another object of the present invention to provide a method for ventilating an enclosed region within a secure facility, for example, for ventilating an inmate cell within a prison, and to provide a system and apparatus used therefore, wherein air being ventilated thereby is filtered near the enclosed region.

More particularly, a security vent according to a preferred embodiment of the present invention includes a housing assembly having an open first end fixedly secured to an inlet end of a return air duct and an open second end fixedly secured to a wall portion of an enclosed region of the secure facility, such as, for example, an inmate cell, and defining an opening through the wall portion by which air may be conveyed from the enclosed region, through the housing assembly and into the return air duct. A drawer assembly is slidingly received by the second end of the housing assembly between a closed position and an open position, wherein the drawer assembly is securable to the housing assembly by a latch assembly when the drawer assembly is in the closed position, and wherein a filter tray is exposed when the drawer assembly is in the open position. Removal of the drawer assembly from within the housing assembly is prevented by first and second stops provided on an inner surface of the housing assembly. A filter is removably received by the filter tray when the drawer assembly is in the open position and is slidingly received within the housing assembly when the drawer assembly is in the closed position. The latch assembly is mounted within the housing assembly to prevent unauthorized opening of the drawer assembly and requires a latch key designed specifically therefor to unlock.

A security vent according to a preferred embodiment of the present invention includes a housing assembly mounted to a support, the housing assembly including a side wall portion having first and second distal ends thereof and defining a passageway therebetween; a drawer assembly having a filter-receiving slot therein, the drawer assembly being slidingly received by the housing assembly second distal end, the drawer assembly being moveable within the housing assembly passageway between an open position and a closed position, wherein the filter-receiving slot is disposed within the housing assembly when the drawer assembly is in the closed position, and wherein the filter-receiving slot is in communication with a region outside the housing support when the drawer assembly is in the open position; and, a latch assembly mounted to the housing assembly, the latch assembly being moveable between a locked position and an unlocked position, the latch assembly being received by a latch-receiving notch provided in the drawer assembly when the drawer assembly is in the closed position and the latch assembly is in the locked position.

A security vent according to another preferred embodiment of the present invention is mountable to an existing air duct inlet opening and includes a housing assembly having a mounting frame fixedly secured to an inlet end of an air duct and a housing wall fixedly secured to the mounting frame by at least one side wall portion. The housing wall includes a front face being in spaced relation to the mounting frame and includes a perforated front face thereof. The mounting frame includes an opening therethrough which cooperates with the perforated front face of the housing wall to permit flow communication of the air duct through the security vent. The housing wall cooperates with the mounting frame to define a filter-receiving region therebetween. A door is hingedly attached to an open side wall and is moveable between an open position and a closed position. A latch assembly is fixedly attached to the door and is moveable between a locked position and an unlocked position. The latch assembly is receivable by a latch-receiving aperture in the mounting frame to lock the door in the closed position. The filter-receiving region communicates through the open side wall to receive a filter therein.

A security vent according to a preferred embodiment of the present invention includes a housing assembly, the housing assembly including a mounting frame and a housing wall having at least one side wall portion connecting the housing wall to the mounting frame, the mounting frame having an opening therethrough, the at least one side wall portion defining an open side thereof, the housing wall having a front face portion thereof being in spaced relation to the mounting frame and cooperating with the at least one side wall portion to define a filter-receiving region therebetween, the housing wall front face having at least one opening therethrough; a door hingedly attached to the open side of the housing wall, the door being moveable between an open position and a closed position, wherein the filter-receiving region is in communication with a region exterior to the housing wall when the door is in the open position; and, a latch assembly mounted to the door, the latch assembly being moveable between a locked position and an unlocked position, the latch assembly being received by a latch-receiving aperture provided in the mounting frame when the door is in the closed position.

The present invention is also for a method for ventilating an enclosed region within a secure facility, for example, for ventilating an inmate or patient cell within a prison, mental hospital or the like, and for a system and apparatus used therefor. More particularly, a system for ventilating an enclosed region within a secure facility according to a preferred embodiment of the present invention includes a supply side air handling unit and a return side air handling unit, wherein each air handling unit is adapted to pump air to and from, respectively, the enclosed region to exchange stale air contained within the enclosed region with fresh air existing in the ambient, which surrounds the facility. The supply side air handling unit is in air-flow communication with the enclosed region by a supply side duct, which is open at an outlet end thereof to the interior of the enclosed region. The return side air handling unit is in air-flow communication with the enclosed region by a return side duct, which is open at an inlet end thereof to the interior of the enclosed region. A removable filter is positionable within the return side duct near the inlet end thereof, such that the stale air is filtered prior to entering the return side duct and prior to returning to the return side air handling unit. A secure filter unit is attached to the inlet end of the return side duct and provides secure access to the removable filter positioned therein.

A method for ventilating an enclosed region within a secure facility according to a preferred embodiment of the present invention includes the steps of supplying fresh air to the enclosed region by a supply side air handling unit and removing stale air from the enclosed region by a return side air handling unit, wherein the stale air is filtered prior to returning to the return side air handling unit, and preferably, near the enclosed region.

An apparatus for ventilating an enclosed region within a secure facility according to a preferred embodiment of the present invention includes an outer housing mounted to a wall of the enclosed region and an access door which is connected to the outer housing and is moveable between a closed position and an open position such that a filter is removable from the apparatus when the access door is in an open position and wherein the access door is securely affixed to the outer housing when the access door is in a closed position.

A system for ventilating a secure facility according to a preferred embodiment of the present invention includes a supply side being in air-flow communication with the enclosed region and a return side being in air-flow communication with the enclosed region, the supply side having a supply side fan to discharge fresh air into the enclosed region, the return side having a return side fan to remove stale air from the enclosed region through a return side intake, the improvement comprising a secure vent unit affixed to a wall of the enclosed region near the return side intake, the secure vent unit having a filter removably received thereby to filter the stale air near the return side intake, the secure vent unit having an access door being moveable between a closed position and an open position, wherein access to the return side intake is prevented by the access door when the access door is in the closed position, and wherein the filter is removable from the secure vent unit when the door is in the open position.

A method for ventilating a secure facility according to a preferred embodiment of the present invention includes the steps of providing a system for ventilating the enclosed region, discharging the fresh air into the enclosed region, providing a secure vent unit and removing the stale air from the enclosed region, wherein the stale air is filtered before removing the stale air from the enclosed region.

An apparatus for filtering air in a secure facility according to a preferred embodiment of the present invention includes an outer housing mounted to a support, the outer housing including a side wall portion having first and second distal ends thereof and defining a passageway therebetween; an access door securely affixed to the outer housing, the access door being moveable between a closed position and an open position, the access door spanning substantially the passageway when the access door is in the closed position; and, means for positioning a filter along the passageway, the filter spanning substantially the passageway.

BRIEF DESCRIPTION OF THE DRAWINGS

A better understanding of the present invention will be had upon reference to the following description in conjunction with the accompanying drawings in which like numerals refer to like parts, and wherein:

FIG. 28 is a front perspective view of the apparatus of FIG. 27, shown assembled and with an access door thereof being in an open position;

FIG. 29 is a front perspective view of the apparatus of FIG. 27, shown assembled and with the access door thereof being in a closed position;

DETAILED DESCRIPTION OF THE PREFERRED EMBODIMENTS

Figure 1:
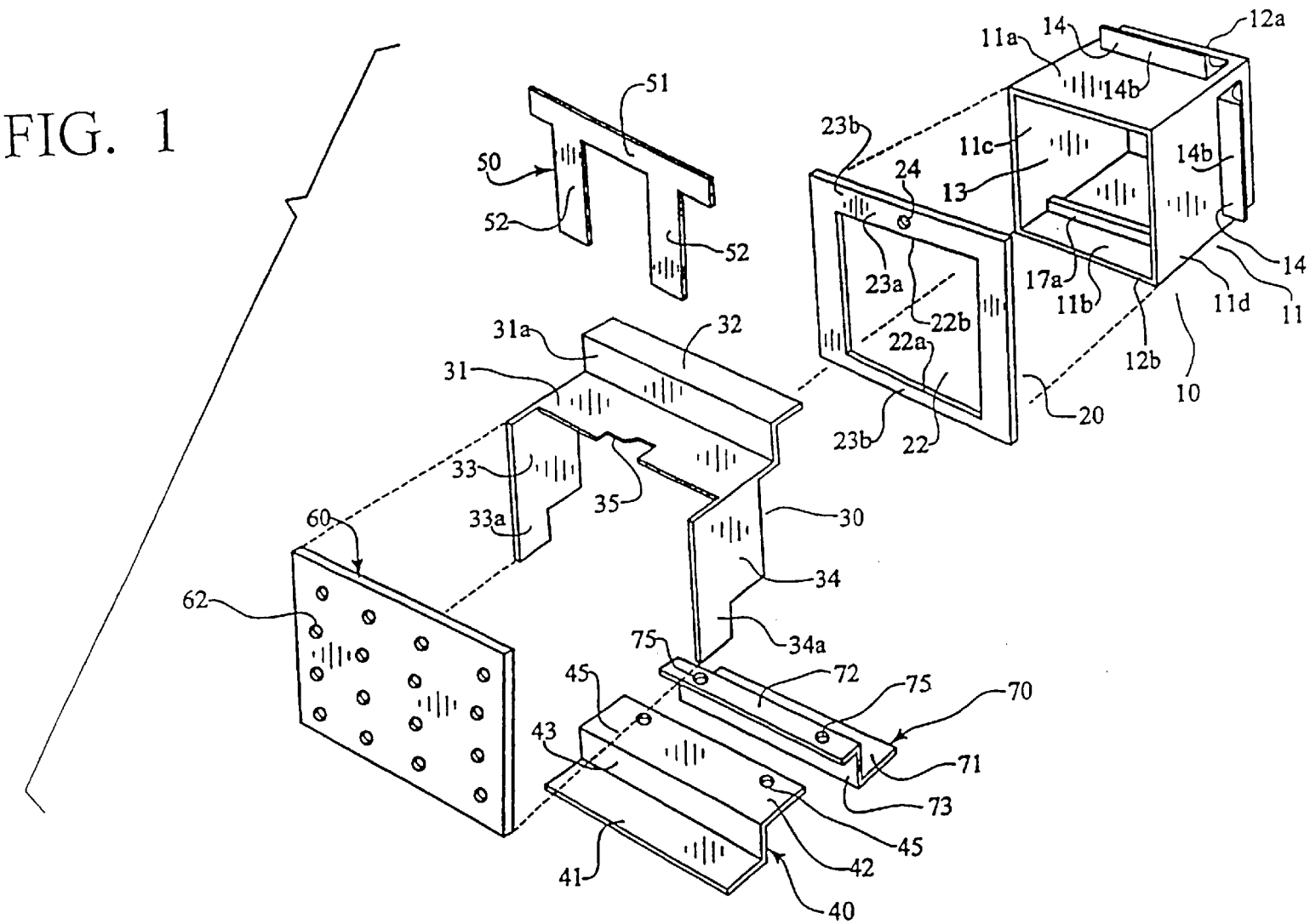
FIG. 1 is an exploded perspective view of a security vent according to a one embodiment of the present invention.

With reference to FIG. 1, a security vent 5 according to an embodiment of the present invention includes an outer housing 10, a housing face 20, a drawer top 30, a drawer bottom 40, a filter stop 50, a drawer face 60 and a removable clip 70, each of which is preferably constructed from malleable hot-rolled steel which is sized, shaped and oriented as described hereinbelow. However, any suitable material being respectively formable into a similar size, shape and orientation thereof may be substituted in place thereof without departing from either the spirit or the scope of the present invention.

Figure 2:
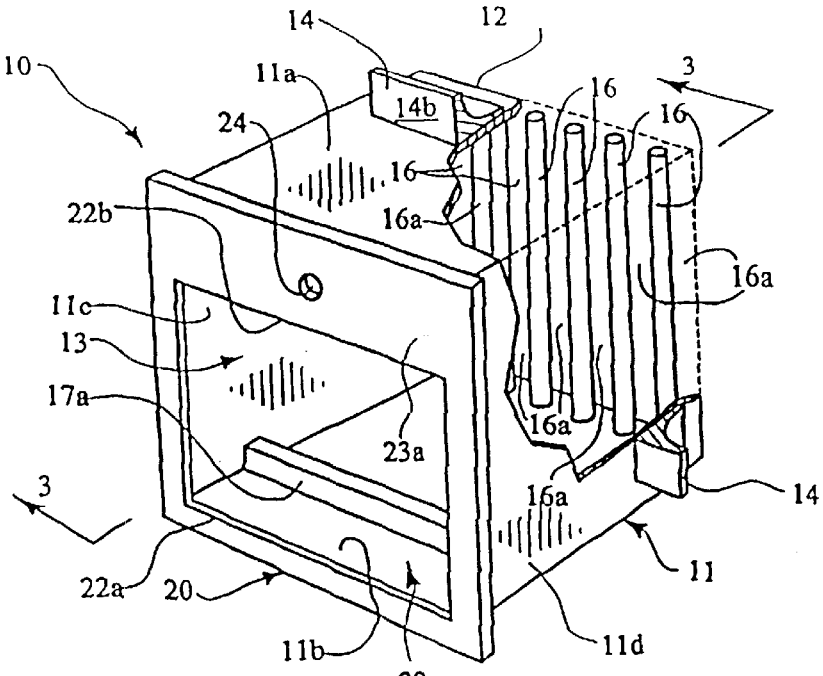
FIG. 2 is a perspective cut-away view of an outer housing of the security vent of FIG. 1.
Figure 3:
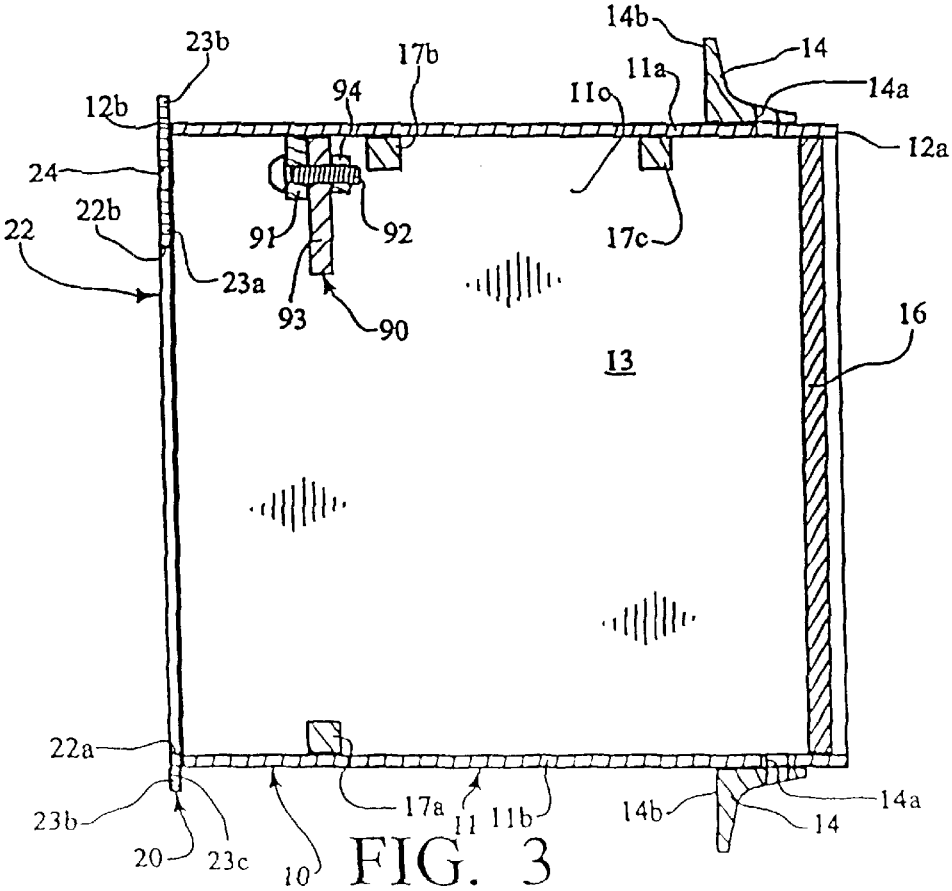
FIG. 3 is a section view of the outer housing of FIG. 2, shown along section line 3—3 of FIG. 2.

With additional reference to FIGS. 2 and 3, the outer housing 10 includes a substantially box-shaped side wall 11 having first and second open distal ends 12*a*, 12*b*, respectively, defining a passageway 13 therebetween. The side wall 11 includes first and second horizontal wall portions 11*a*, 11*b*, respectively, being in spaced parallel relation to one another, and first and second vertical wall portions 11*c*, 11*d*, respectively, being in spaced parallel relation to one another. Respective first and second longitudinal side edges of the horizontal wall portions 11*a*, 11*b* are integrally-formed with, or otherwise fixedly secured to, such as, for example, by welding, to upper and lower longitudinal edges of the vertical wall portions 11*c*, 11*d*, thereby forming the preferred box-shaped construction of the outer housing 10. The side wall 11 is sized and shaped to permit sliding engagement of an inlet end (FIG. 10) of a return air duct 8 (FIG. 10) therein, wherein the first distal end 12*a* of the outer housing 10 is fixedly secured, such as, for example, by welding, to the inlet end of the return air duct 8.

A plurality of rods 16 are integrally-formed with, or are otherwise fixedly secured, such as, for example, by welding, to respective opposing inner surfaces of the first and second horizontal wall portions 11*a*, 11*b* at distal ends thereof near the first distal end 12*a* of the outer housing 10. The plurality of rods 16 are in equidistantly-spaced relation to one another across the passageway 13 between the first and second vertical wall portions 11*c*, 11*d* to define a plurality of open spaces 16*a* therebetween being sized approximately 4 to 6 inches in width. Each of the plurality of open spaces 16*a* is sized to prevent passage therethrough by an individual of small proportions.

A lower stop 17*a* is integrally-formed with, or is otherwise fixedly secured, such as, for example, by welding, to an inner surface of the second horizontal wall portion 11*b* and extends between opposing inner surfaces of the first and second vertical wall portions 11*c*, 11*d* near the second distal end 12*b* of the outer housing 10. A first upper stop 17*b* is integrally-formed with, or is otherwise fixedly secured, such as, for example, by welding, to an inner surface of the first horizontal wall portion 11*a* and extends between the opposing inner surfaces of the first and second vertical wall portions 11*c*, 11*d* near the second distal end 12*b* of the outer housing 10. A second upper stop 17*c* is integrally-formed with, or is otherwise fixedly secured, such as, for example, by welding, to the inner surface of the first horizontal wall portion 11*a* and extends between the opposing inner surfaces of the first and second vertical wall portions 11*c*, 11*d* between the first upper stop 17*b* and the second distal end 12*b* of the outer housing 10.

Figure 4:
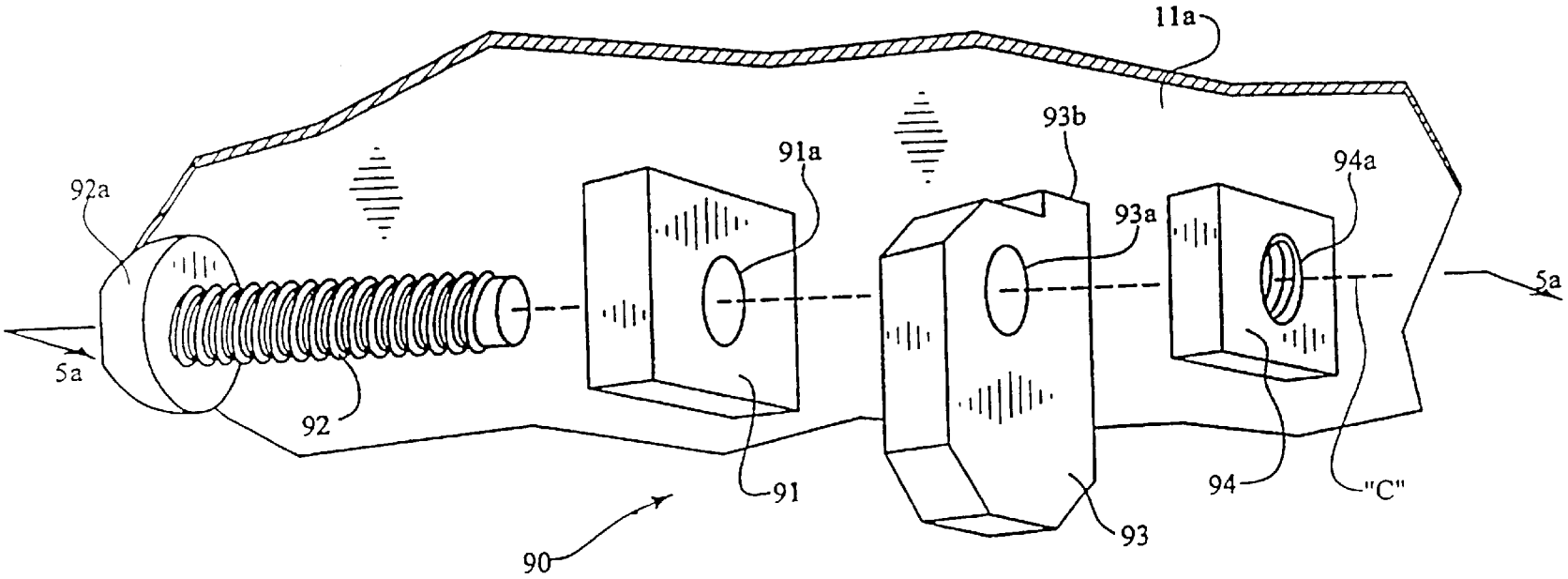
FIG. 4 is an exploded perspective view of a latch assembly of the security vent of FIG. 1.
Figure 5B:
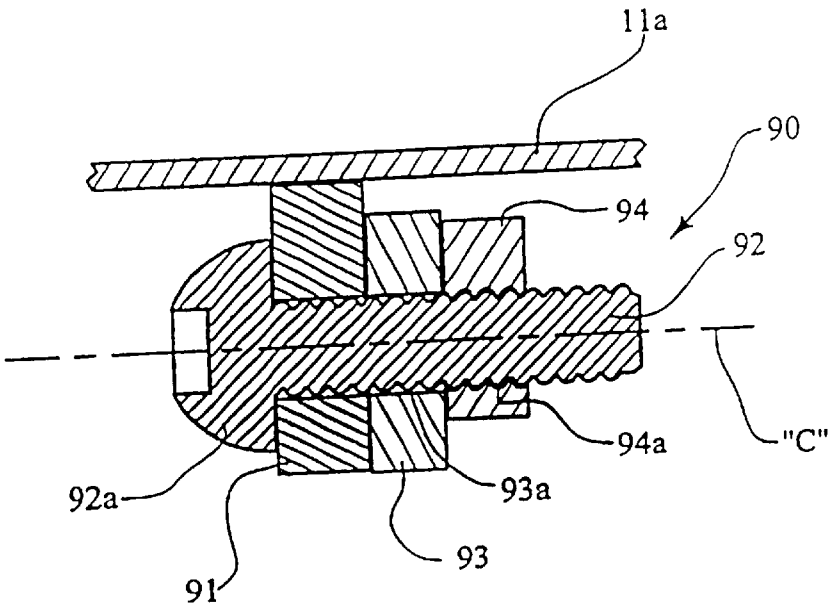
FIG. 5*b* is a section view of the latch assembly of FIG. 4, shown assembled along section line 5*a*—5*a* of FIG. 4, wherein a latch is shown in an "unlocked" position.

With additional reference to FIGS. 4–5*b*, a latch assembly 90 is mounted to the inner surface of the first horizontal wall portion 11*a* between the first upper stop 17*b* and the second distal end 12*b* of the outer housing 10. The latch assembly 90 includes a mount block 91 fixedly secured, such as, for example, by welding, to the inner surface of the first horizontal wall portion 11*a*, a tightening bolt 92 being slidingly received by a mount block throughbore 91*a*, a latch 93 having a bore 93*a* therethrough to slidingly receive the tightening bolt 92 and a lock block 94 threadingly engaging the tightening bolt 92 through a threaded hole 94*a* therethrough. The threads of the lock block 94 and of the tightening bolt 92 are designed such that relative rotation therebetween requires a large torque. As such, the tightening bolt 93 could not be threadingly removed from the lock block 94 by hand-rotation thereof. The latch 93 and the lock block 94 are fixedly secured, such as, for example, by welding, to one another to prevent relative rotation therebetween.

Figure 5A:
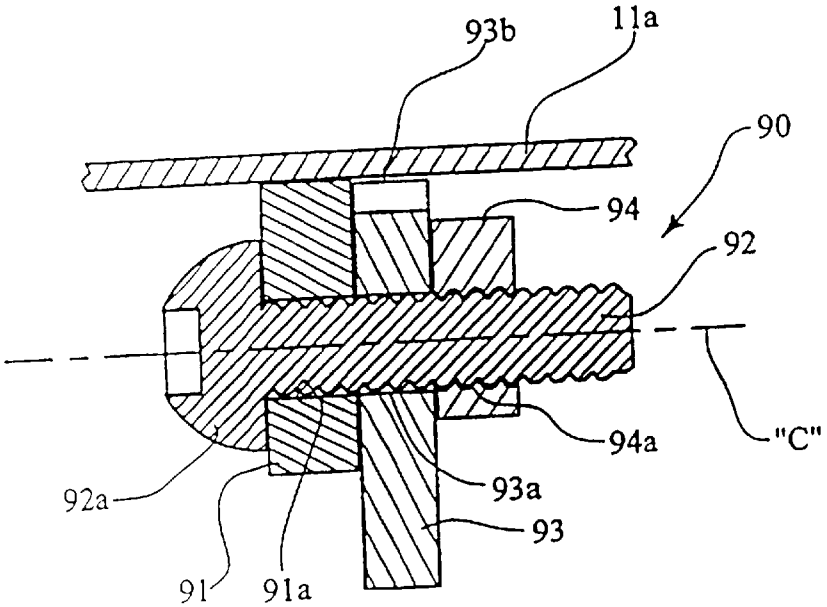
FIG. 5*a* is a section view of the latch assembly of FIG. 4, shown assembled along section line 5*a*—5*a* of FIG. 4, wherein a latch is shown in a "locked" position.

More particularly, the tightening bolt 92 is threadingly engaged with the threaded hole 94*a* of the lock block 94, so that the latch 93 is positioned between the lock block 94 and the mount block 91. The latch 93 is positioned in a "locked" position, as generally shown in FIG. 5*a*, such that an upper step 93*b* of the latch 93 abuts the underside surface of the first horizontal wall portion 11*a*, thereby preventing rotation of the latch 92, and of the lock block 94 fixedly secured thereto, when the tightening bolt 92 is rotated in a clockwise direction. Rotation of the tightening bolt 92 to further engage the lock block 94 causes the latch 93 to move translationally along the axis "C" until the latch 93 abuts and is tightly secured to the mount block 91. Further rotation of the tightening bolt 92 frictionally secures the latch 93 to the mount block 91, pinching the latch 93 between the mount block 91 and the lock block 94, thereby requiring a large torque to unthread the tightening bolt 92 therefrom.

Rotation of the tightening bolt 92 in a counter-clockwise direction, such as to unthread the tightening bolt 92 from within the lock block 94, causes the lock block 94, and the latch 93 fixedly secured thereto, to rotate in a counter-clockwise direction, and into an "unlocked" position, as is generally shown in FIG. 5*b*.

With reference back to FIGS. 1–3, the housing face 20 is shaped substantially like a picture frame and is fixedly secured, such as, for example, by welding, to the second distal end 12*b* of the outer housing 10. The housing face 20 includes an opening 22 therethrough having a perimeter being substantially coextensive with a perimeter of the passageway 13. More particularly, the opening 22 includes a lower transverse edge 22*a* which is flush with the inner surface of the second horizontal side wall portion 11*b* and an upper transverse edge 22*b* spaced between the first transverse edge 22*a* and the first horizontal side wall portion 11*a*, defining a downward lip portion 23*a* therebetween. A key hole 24 is provided through the downward lip 23*a* substantially centered between the first and second vertical side wall portions 11*c*, 11*d* and positioned between the upper transverse edge 22*b* of the opening 22 and the first horizontal side wall portion 11*a* such that the key hole 24 is aligned with the latch assembly 90 along the axis "C". The housing face 20 includes an outer perimeter being larger than an outer perimeter of the outer housing 10, thereby defining a retaining ridge 23*b* projecting outwardly from the outer housing outer perimeter therearound.

At least one flange 14, such as, for example, an "L"-shaped angle beam segment, is fixedly secured, such as, for example, by bolting, to at least one of the side wall portions 11*a*, 11*b*, 11*c*, 11*d*, near the first distal end 12*a* of the outer housing 10 a preselected distance therefrom towards the second distal end 12*b* of the outer housing 10. Preferably, one flange 14 is fixedly secured to each of the side wall portions 11*a*, 11*b*, 11*c*, 11*d*. Further, each flange 14, and its corresponding side wall portion 11*a*, 11*b*, 11*c*, 11*d*, includes at least one hole 14*a* therethrough for receiving a bolt (not shown) therethrough to secure the flange 14 to the side wall 11. Alternatively, the flange 14 may be welded directly to an outer surface of the wall portion 11*a*, 11*b*, 11*c*, 11*d* as hereinbelow described, wherein the holes 14*a* are not provided.

An upright portion of the flange 14 defines a forwardly-facing surface 14*b* thereof which is in spaced relation to a rearwardly-facing surface 23*c* of the retaining ridge 23*b* by a preselected distance. The upright portion of the flange 14 cooperates with the retaining ridge 23*b* to sandwich a portion of a wall 6 (FIG. 10) therebetween, such as, for example, a wall 6 defining an enclosed space of a building, and to mount the security vent 5 thereto as hereinbelow described.

Figure 6:
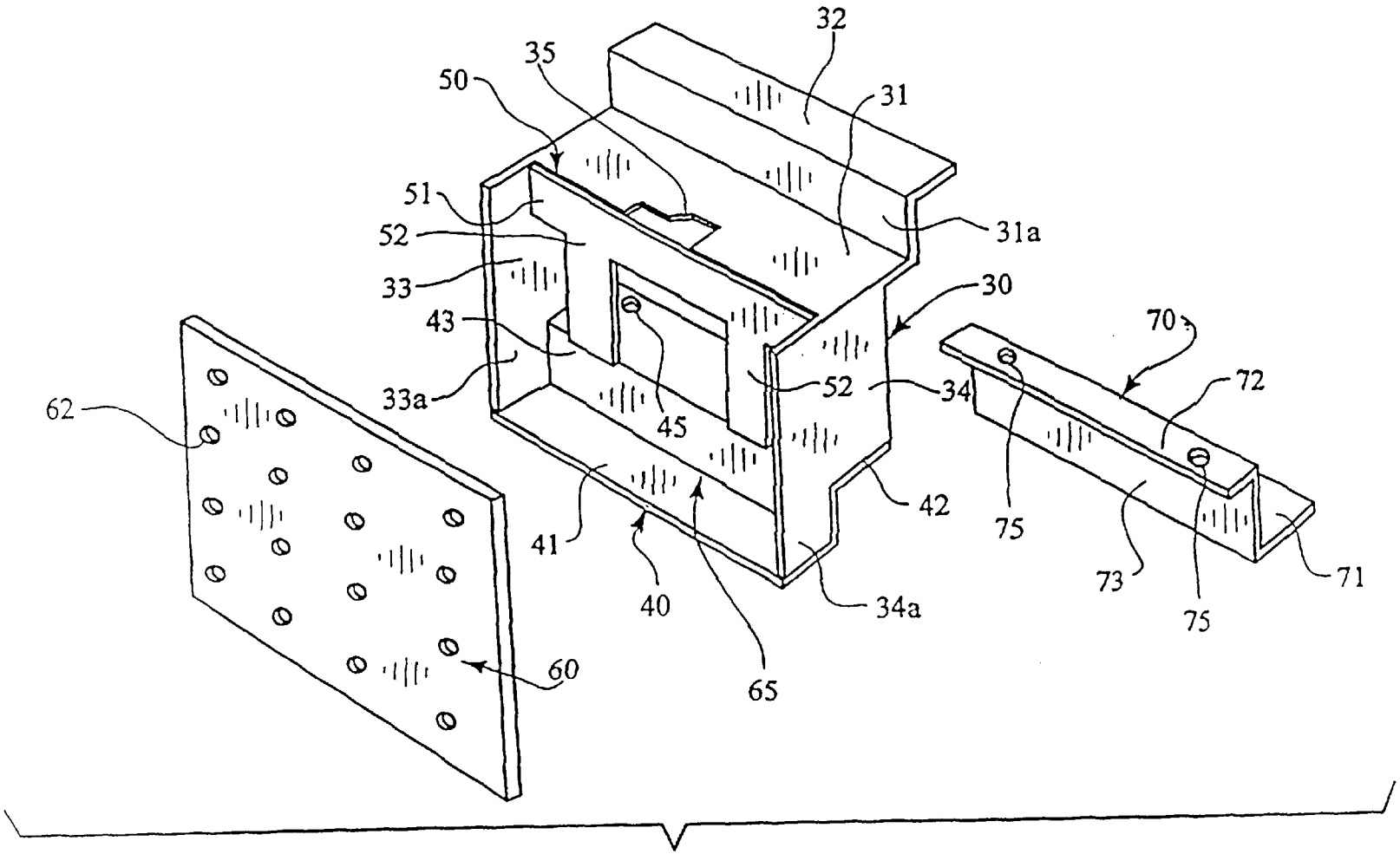
FIG. 6 is an exploded perspective view of a drawer assembly of the security vent of FIG. 1, showing the drawer prior to installation of a perforated face plate thereto.
Figure 7:
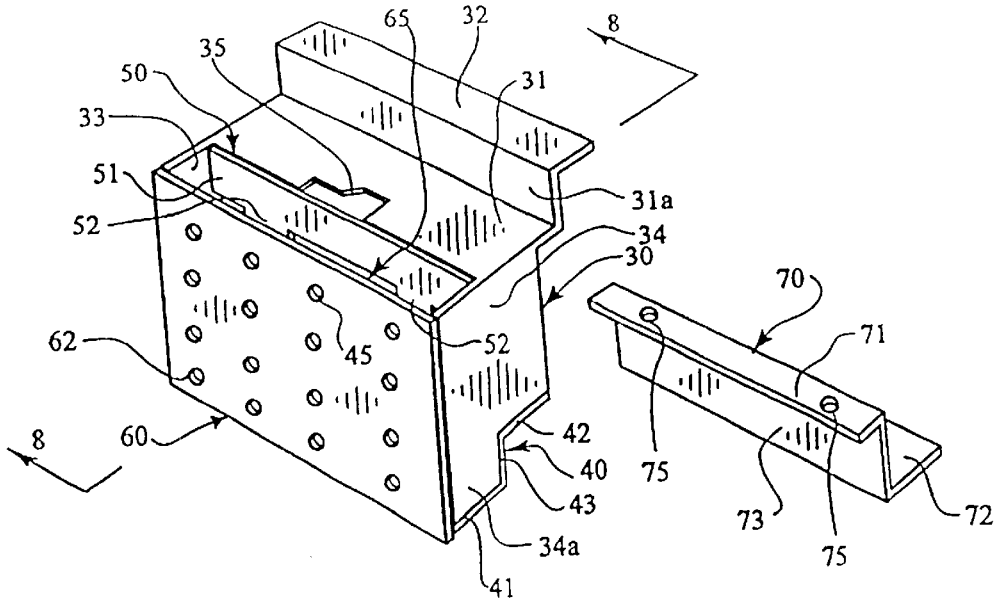
FIG. 7 is another exploded perspective view of a drawer assembly of the security vent of FIG. 1, showing the perforated face plate being installed on the drawer.
Figure 8:
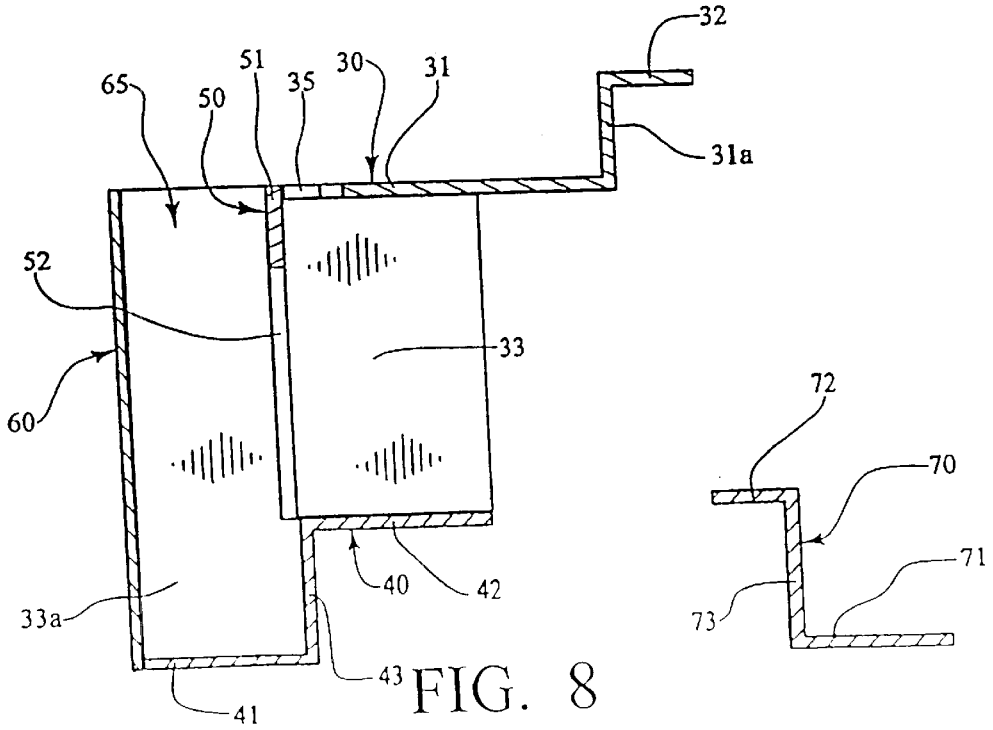
FIG. 8 is a section view of the drawer assembly of FIG. 7, shown along section line 8—8 of FIG. 7.

With reference to FIG. 1 and to FIGS. 6–8, the drawer top 30 includes a horizontal portion 31 having a upwardly-stepped portion 32 connected to a rearward edge of the horizontal portion 31 by a shoulder 31*a*, and a pair of arms 33, 34 projecting forwardly and downwardly from respective first and second side edges thereof. Each arm 33, 34 includes a projection 33*a*, 34*a*, respectively, depending downwardly therefrom a preselected distance. The horizontal portion 31 includes a stepped notch 35 cut out from a forward edge thereof centered between the first and second arms 33, 34, and sized to receive the latch 93.

The drawer bottom 40 includes a horizontal lower portion 41, and a horizontal upper portion 42 connected to the lower portion by a vertical shoulder 43. The drawer bottom 40 is fixedly secured, such as, for example, by welding, to each of the drawer top arms 33, 34 such that an upper surface of the horizontal lower portion 41 abuts and is secured to lower edges of each of the arm projections 33*a*, 34*a*, respectively. Further, a forwardly-facing surface of the vertical shoulder portion 43 abuts and is secured to rearward edges of each of the arm projections 33*a*, 34*a*, respectively. An upper surface of the horizontal upper portion 42 abuts and is secured to the lower edges of each of the arms 33, 34. At least one hole 45, and preferably two holes 45, are provided through the horizontal upper portion 42 towards a rearward edge thereof.

The filter stop 50 includes a longitudinal cross-member 51 fixedly secured, such as, for example, by welding, at longitudinal distal ends thereof to opposing inwardly-facing surfaces of the arms 33, 34 towards the drawer top horizontal portion 31. At least one downward member 52 is integrally-formed with and depends downwardly from the cross-member 51 and is fixedly secured, such as, for example, by welding, to the drawer bottom 40 near the intersection of the horizontal upper portion 42 and the vertical shoulder portion 43.

The drawer face 60 includes a plurality of orifices 62 therethrough and is fixedly secured, such as, for example, by welding, to respective forward edges of the drawer top arms 33, 34, arm projections 33*a*, 34*a*, and drawer bottom horizontal lower portion 41 around an outer perimeter thereof. The drawer face 60 is in spaced relation to the filter stop 50 and cooperates to define a filter-receiving slot 65 therebetween, having a perforated front defined by the drawer face 60, closed sides defined by the arms 33, 34, a closed bottom defined by the drawer bottom horizontal lower portion 41, a substantially open rear defined by the filter stop 50, and an open top sized to receive a filter 80 (FIG. 9) therein. The filter 80 is preferably constructed from fiberglass or the like. The drawer face 60 is sized and shaped substantially similar to the size and shape of the perimeter of the housing face opening 22.

The removable clip 70 includes a lower portion 71 and an upper portion 72 connected to the lower portion 71 by a shoulder 72. The horizontal upper portion 72 includes at least one hole 75, and preferably two holes 75, therethrough towards a forward edge thereof. The portions 71, 72, 73 of the removable clip 70 are respectively sized to permit the removable clip upper portion 72 to be slidingly received forwardly between the drawer top arms 33, 34, wherein a lower surface of the removable clip upper portion 72 is slidingly received over an upper surface of the drawer bottom horizontal upper portion 42 such that the drawer bottom holes 45 are aligned with the removable clip holes 75 when a forward face of the removable clip shoulder portion 73 abuts a rearward edge of the drawer bottom horizontal upper portion 42. The removable clip 70 is removably secured, such as, for example, by bolting, to the drawer bottom 40, by a bolt 2 passing through the holes, 45, 75 and threadingly secured to a nut 3. The removable clip portions 71, 72, 73 are further disposed such that a lower surface of the removable clip lower portion 71 is substantially coplanar with a lower surface of the drawer bottom horizontal lower portion 41 when the removable clip 70 is removably secured to the drawer bottom 40 as hereinabove described.

With respect to FIGS. 9 and 10, the stops 17*a*, 17*b*, 17*c*, the latch assembly 90 and the housing face 20 are assembled as hereinabove described and cooperate to define a welded housing assembly. An opening 7 is provided in a wall 6 defining an enclosed region within a building, such as, for example, an inmate cell within a penal institution. The opening 7 is provided adjacent to an inlet end of a return air duct 8, which is disposed behind the wall 6, and is connected to a heating, ventilating and air-conditioning system to remove air from the enclosed region thereby. The opening 7 is sized and shaped to receive the first distal end 12*a* of the outer housing 10 therethrough, and to slidingly receive the outer housing 10 therethrough such that the rearwardly-facing surface 23*c* of the retaining ridge 23 abuts a room-side surface 6*a* of the wall 6. The at least one flange 14 is mounted to the outer housing 10 as hereinabove described, such as, for example, by welding or bolting, such that the forwardly-facing surface 14*b* of the flange upright portion abuts a back-side surface 6*b* of the wall 6, sandwiching the wall 6 between the at least one flange 14 and the retaining ridge 23*b* of the housing face 20. The inlet end of the return air duct 8 is received by the first distal end 12*a* of the outer housing 10 and welded, bolted or otherwise secured thereto.

The drawer top 30, the drawer bottom 40, the filter stop 50 and the drawer face 60 are assembled as hereinabove described and cooperate to define a welded drawer assembly which is received by the housing assembly through the opening 22 of the housing face 20 and into the housing passageway 13. More particularly, the upwardly-stepped portion 32 of the drawer top 31 is inserted into the opening 22 and the drawer assembly is positioned into a substantially horizontal orientation such that an upper surface of the stepped portion 32 abuts, and is in sliding relation to, the inner surface of the first horizontal wall portion 11*a* between the second and third stops 17*b*, 17*c*, respectively.

The removable clip 70 is attached to the drawer bottom 40 as hereinabove described such that a lower surface of the lower portion 71 of the removable clip 70 abuts, and is in sliding relation to, the inner surface of the second horizontal wall portion 11*b* of the outer housing 10 between the first stop 17*a* and the first distal end 12*a* of the housing portion 10. Alternatively, the removable clip 70 may be attached to the drawer bottom 40 prior to mounting the housing assembly to the wall 6.

Figure 9:
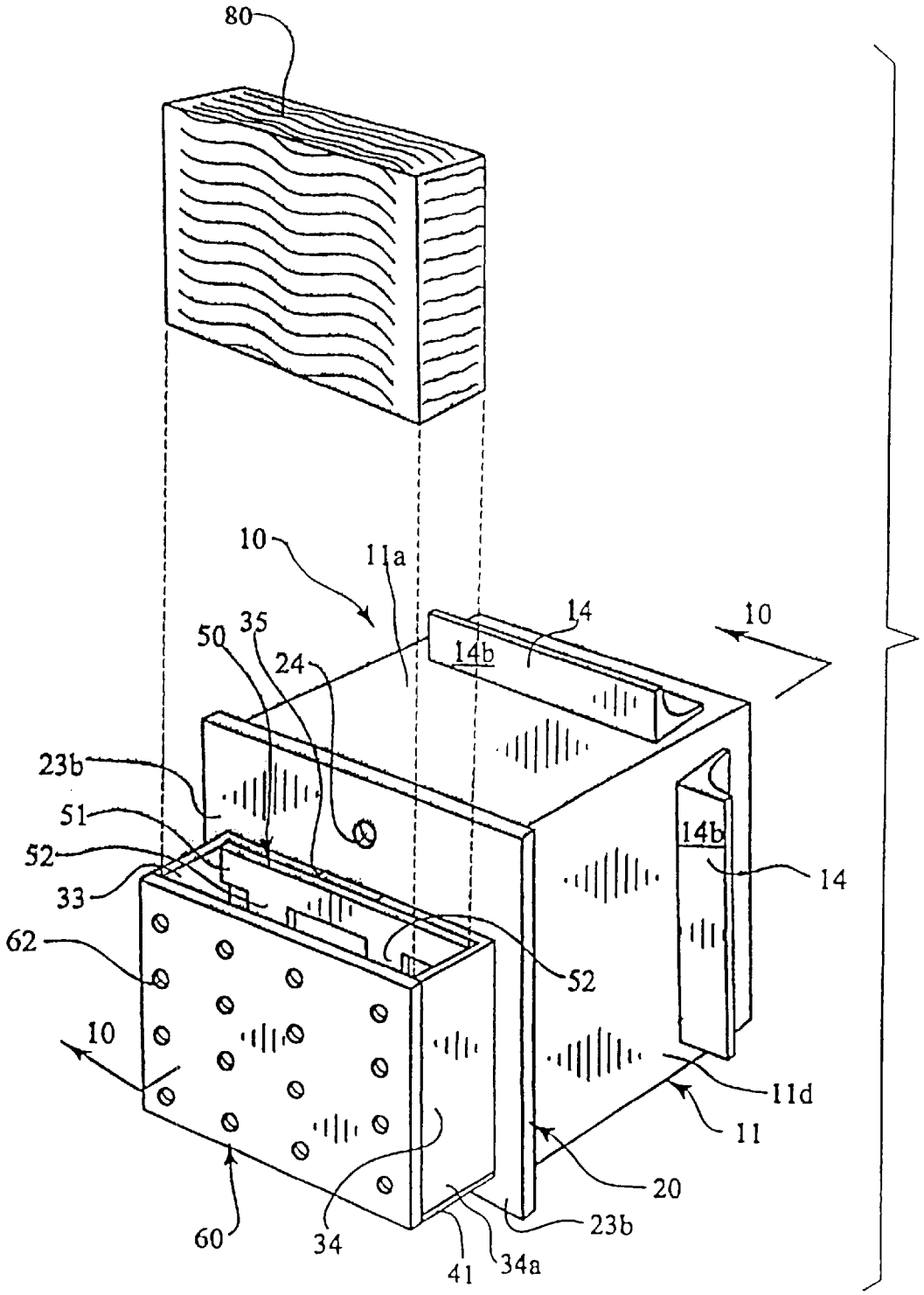
FIG. 9 is a perspective view of the security vent of FIG. 1, shown assembled, wherein the drawer is shown in an "open" position, and wherein a filter is shown in spaced relation thereto.
Figure 10:
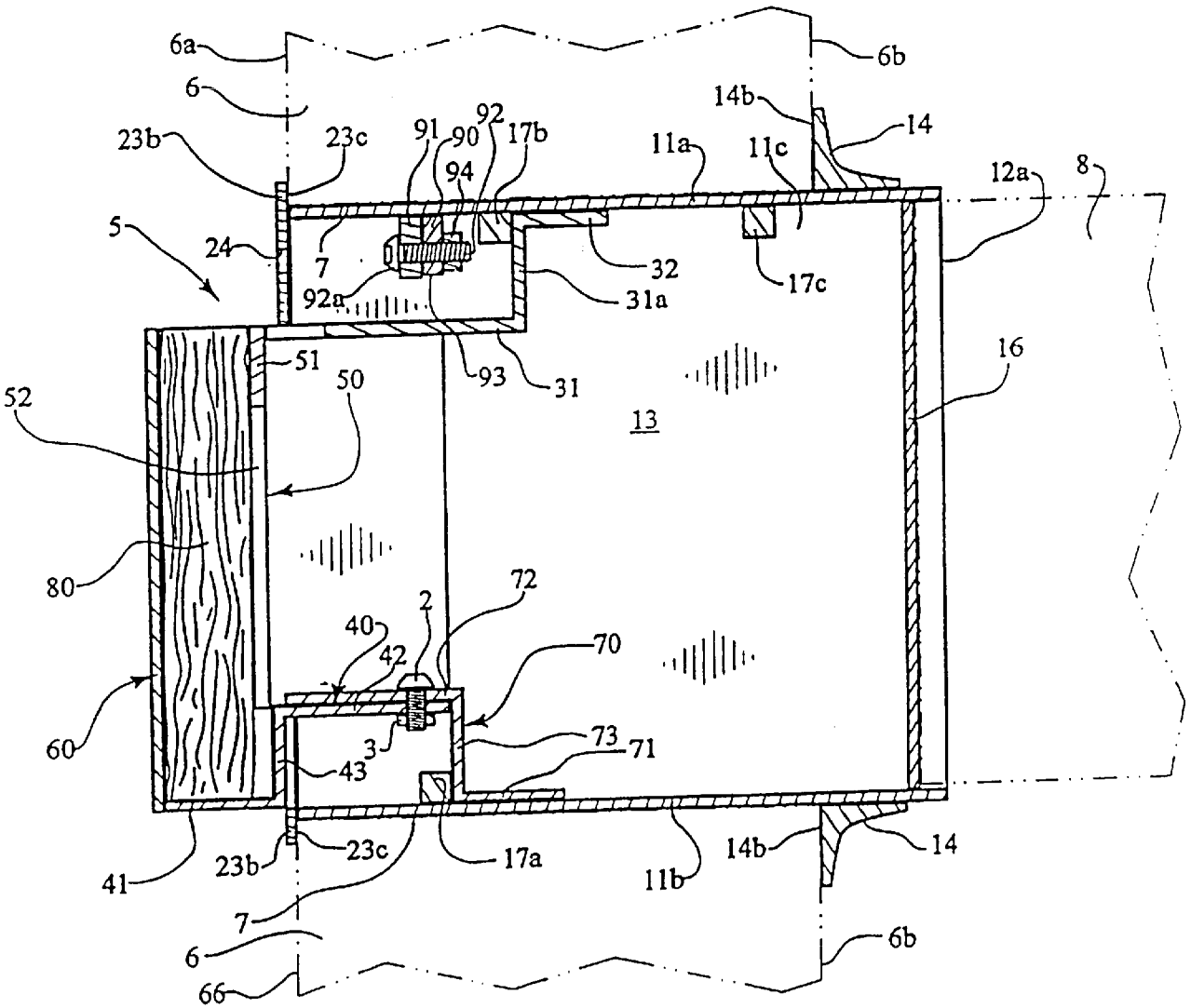
FIG. 10 is a section view of the security vent of FIG. 9, shown assembled along section line 10—10 of FIG. 9, wherein the drawer is shown in an "open" position, wherein the filter is shown inserted into the drawer, and wherein portions of a wall and portions of an air duct are shown in phantom attached to the security vent.

The stops 17*a*, 17*b*, the drawer top 30, the drawer bottom 40 and the removable clip 70 are each sized and positioned such that the forward face of the removable clip shoulder 73 and a forward face of the shoulder portion 31*a* of the drawer top 30 abut the stops 17*a*, 17*b*, respectively, when the drawer assembly is in an "open" position, as shown in FIGS. 9 and 10, thereby preventing forward sliding movement of the drawer assembly within the housing assembly beyond the stops 17*a*, 17*b*. The drawer assembly cannot be removed from the housing assembly without first removing the removable clip 70 therefrom. Further, because the forward travel of the drawer assembly is limited to the "open" position, wherein only enough of the drawer assembly is exposed to permit an individual to insert the filter 80 downwardly into the filter-receiving slot 65, removal of the removable clip 70 is very difficult from the front of the security vent 5, through the housing opening 22, thereby rendering access to the passageway (and to the air duct 8 connected thereto) by an individual of small proportions very difficult. Accordingly, even if an individual successfully unlocks the security vent 5 and moves the drawer assembly into the "open" position, escape from the enclosed region therethrough is prevented. Further, rods 16 prevent escape by an individual through the security vent 5.

Once the removable clip 70 has been attached to the drawer assembly as hereinabove described, the filter 80 is inserted downwardly into the filter-receiving slot 65, and the drawer assembly is slidingly moved rearwardly within the housing assembly until the drawer face 60 is flush with the housing face 20, at which point, the third stop 17*c* abuts the rearward edge of the drawer top upwardly-stepped portion 32 and prevents further rearwardly travel of the drawer assembly within the passageway 13 of the outer housing 10.

Figure 11:
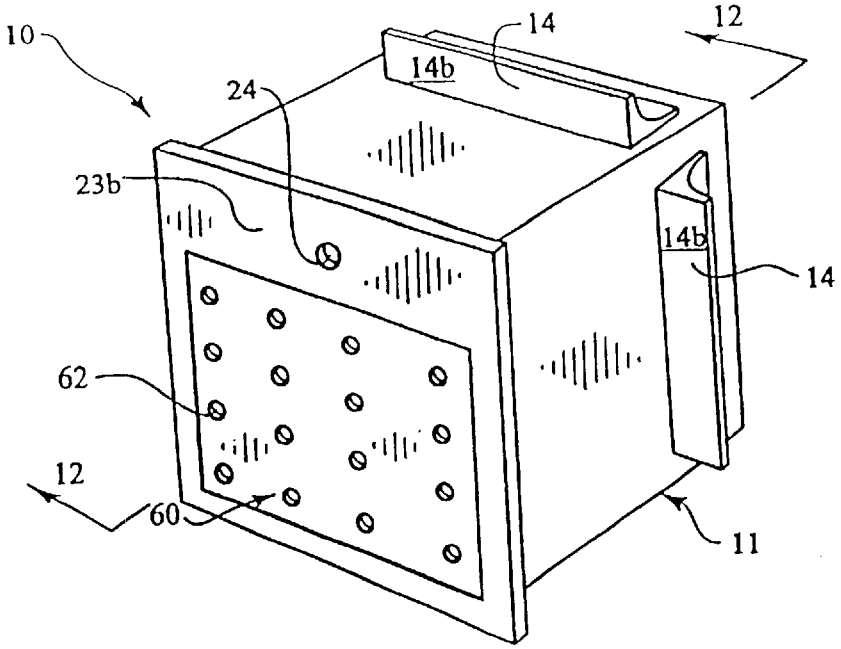
FIG. 11 is a perspective view of the security vent of FIG. 1, shown assembled, wherein the drawer is shown in a "closed" position.
Figure 12:
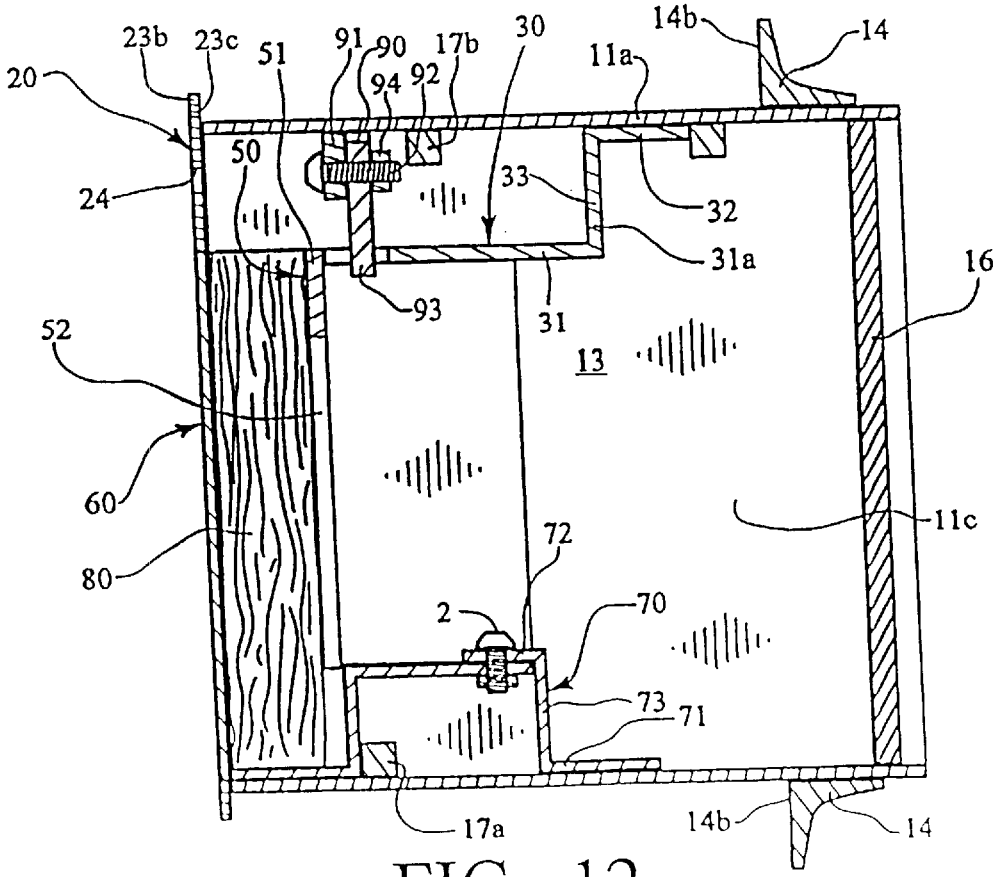
FIG. 12 is a section view of the security vent of FIG. 11, shown assembled along section line 12—12 of FIG. 11, wherein the drawer is shown in a "closed" position, and wherein a filter is shown inserted into the drawer.

With respect to FIGS. 11 and 12, the drawer assembly is slidingly received within the passageway 13 of the housing assembly, and the latch 93 is manipulated into the "locked" position to extend downwardly into the stepped notch 35, thereby preventing either forwardly or rearwardly travel of the drawer assembly within the passageway 13 of the housing assembly. The frictional fit between the latch 93 and the mount block 91 prevents counter-clockwise rotation of the latch 93 without applying a large torque thereto. Because the drawer face 60 is flush with the housing face 20, an individual is unable to pull the drawer assembly forwardly from within the passageway 13 of the housing assembly without first manipulating the latch 93 into the "unlocked" position out of the stepped notch 35. The filter stop 50, the filter 80 and the drawer face orifices 62 permit air to flow therethrough from the air duct 8 (FIG. 10) with only nominal static pressure being developed within the air duct 8 behind the filter 80.

A head portion 92*a* of the tightening screw 92 is provided with a hexagonal or other similarly shaped recess, which requires a key having a similar size, shape and geometry to rotate same. Accordingly, unwanted rotation of the latch 93 into the "unlocked" position out of the stepped notch 35, without the key, is prevented thereby.

Figure 13:
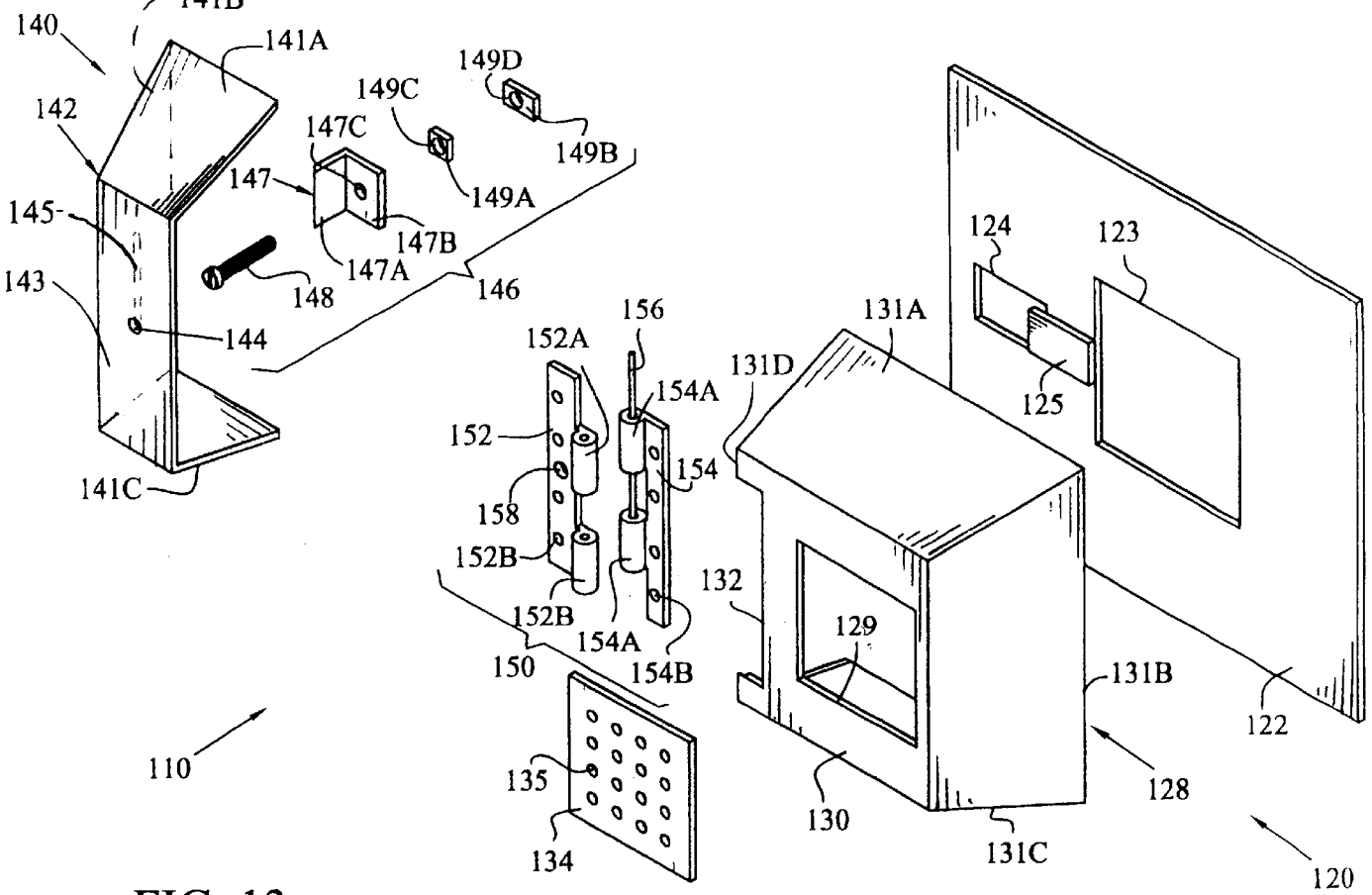
FIG. 13 is an exploded perspective view of another embodiment of a security vent according to the present invention.
Figure 14:
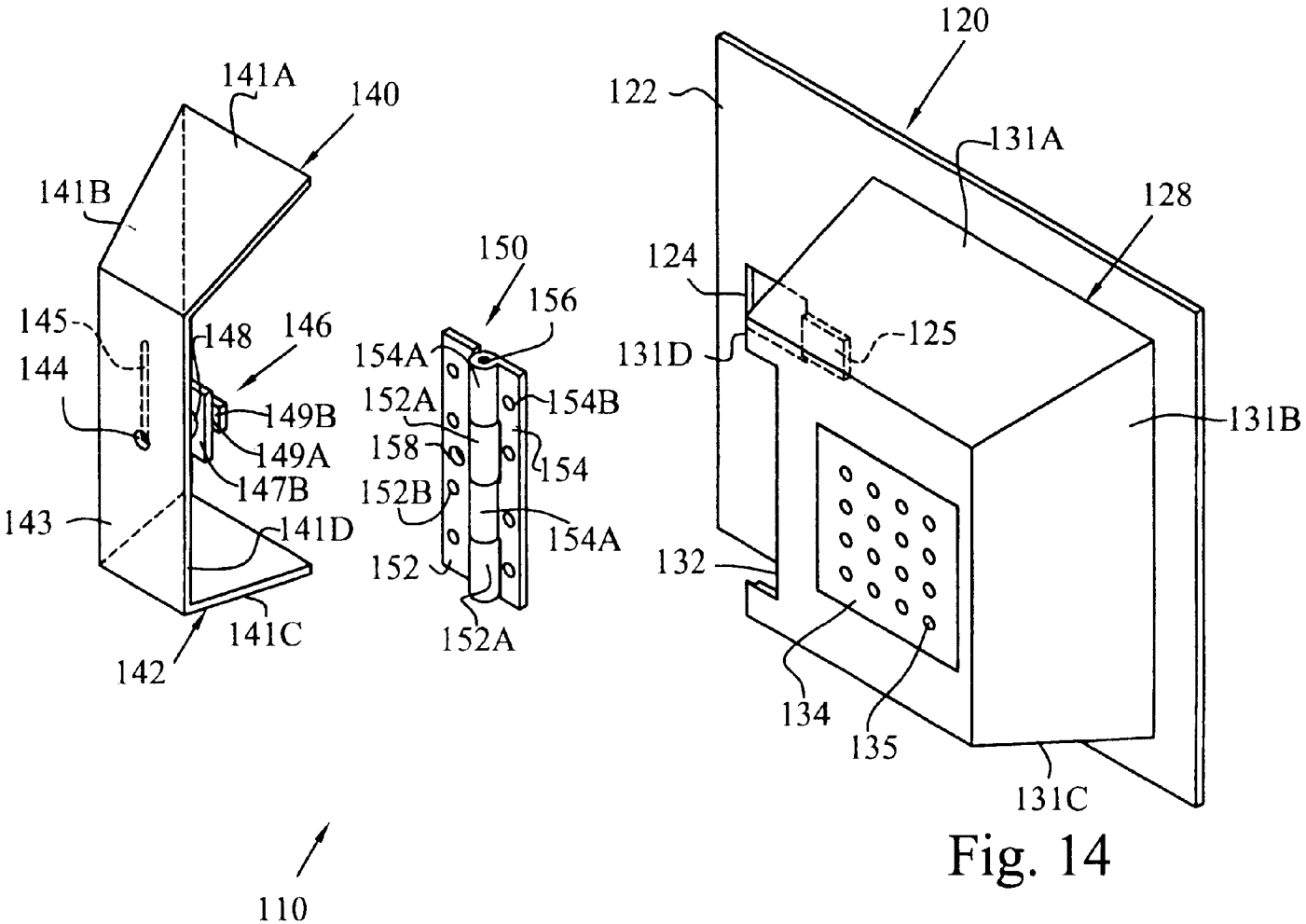
FIG. 14 is an exploded perspective view of the security vent of FIG. 13.
Figure 15:
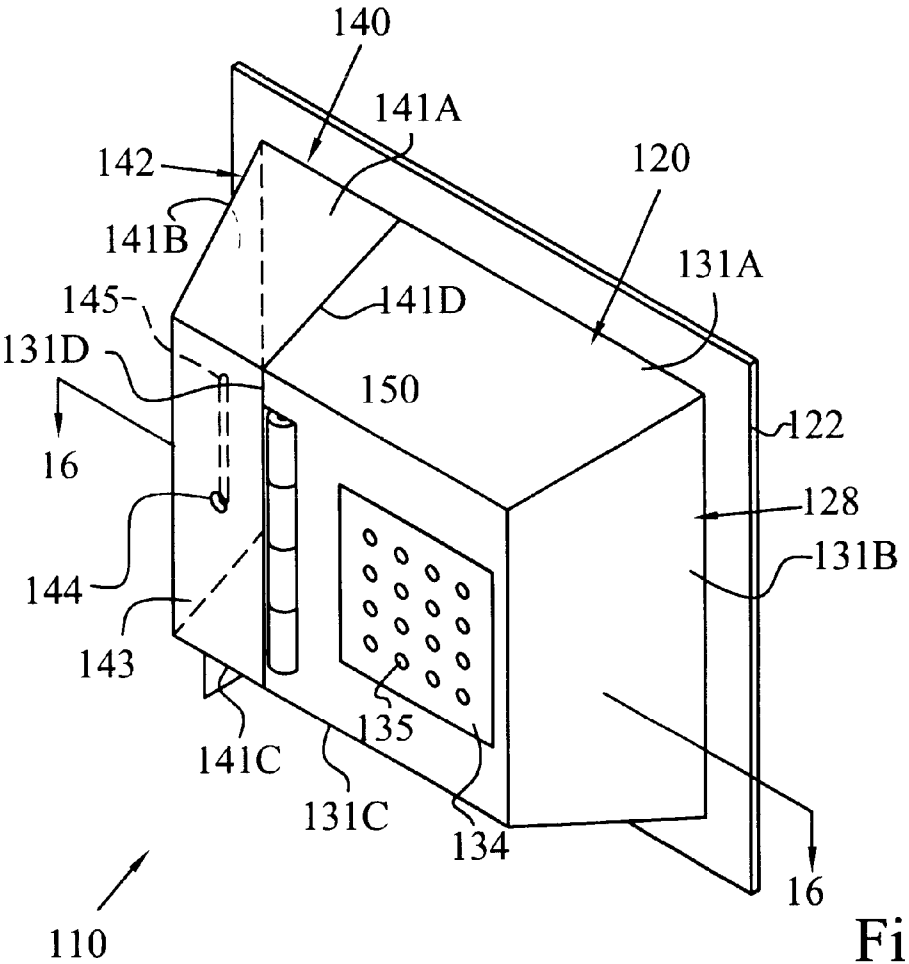
FIG. 15 is a perspective view of the security vent of FIG. 13, shown fully assembled and in a "closed" position.

With reference to FIGS. 13–15, a security vent 110 according to another embodiment of the present invention includes a housing assembly 120 and a door assembly 140 hingedly connected to the housing assembly 120 by a hinge 150. The housing assembly 120 and the door assembly 140 are each preferably constructed from malleable hot-rolled steel which is sized, shaped and oriented as described hereinbelow. However, any suitable material being respectively formable into a similar size, shape and orientation thereof may be substituted in place thereof without departing from either the spirit or the scope of the present invention.

The hinge 150 is preferably a continuous hinge 150 having a door bracket 152, a housing bracket 154 and a pin 156 frictionally receivable by engageable pin-receiving portions 152*a*, 154*a* of the brackets 152, 154, respectively. A plurality of weld holes 152*b*, 154*b* are provided through each of the brackets 152, 154, respectively, to permit welded attachment of the brackets 152, 154 to the door assembly 140 and the housing assembly 120, respectively. A bracket key hole 158 is provided through the door bracket 152 near a midpoint thereof. Any suitable hinge known in the art may be substituted in place of the hinge 150 provided herein without departing from either the spirit or the scope of the present invention.

The housing assembly 120 includes a mounting frame 122, a beveled housing wall 128 and a perforated housing face 134. The mounting frame 122 is shaped substantially like a picture frame and includes an opening 123 therethrough sized to fit over an inlet opening of a return air duct provided in a wall of a building. A latch-receiving aperture 124 is provided through the mounting frame 122 near a vertical midpoint thereof and offset from a horizontal midpoint between the opening 123 and a left side thereof. A latch stop 125 is fixedly secured, such as, for example, by welding to the mounting frame 122 such that a portion of the latch stop 125 projects over the aperture 124 a preselected distance towards the left side of the mounting frame 122.

The beveled housing wall 128 is shaped substantially like a beveled picture frame and includes an opening 129 through a front face 130 thereof sized to receive the perforated housing face 134 therein in a flush configuration. The housing face 134 is preferably fixedly secured, such as, for example, by welding, coextensively within the opening 129 to prevent removal of the housing face 134 therefrom.

The front face 130 is surrounded on three sides thereof by rearwardly- and outwardly-beveled sides 131*a*, 131*b*, 131*c*, each of which is fixedly secured, such as, for example, by welding, to the mounting frame 122 around three sides of the mounting frame opening 123 such that the mounting frame opening 123 and the beveled wall opening 129 are substantially aligned. The housing face 134 includes a plurality of orifices 135 therethrough. A left side 131*d* of the housing wall 128 includes a straight edge having a cut-out portion 132 therein which is sized to receive the engaged hinge pin-receiving portions 152*a*, 154*a*. The mounting frame 122 and the beveled housing wall 128 cooperate to define a filter-receiving region 162 (FIG. 16) therebetween.

The door assembly 140 includes a beveled door 142 and a latch assembly 146 fixedly secured, such as, for example, by welding, to an inside surface of the door 142, and projecting rearwardly from the door 142 towards the mounting frame 122. The door 142 includes a front face 143 surrounded on three sides thereof by rearwardly- and outwardly-beveled sides 141*a*, 141*b*, 141*c*. A right side 141*d* of the door 142 includes a straight edge which is sized and shaped to abut the left side edge 131*d* of the housing wall 128, thereby providing a uniform, continuous appearance when the door 142 is connected to the housing wall 128 and is oriented in a "closed" position, such as shown in FIG. 15. A key hole 144 is provided through the front face 143 near a vertical midpoint thereof and a vertical slot 145 is provided through the second beveled side 141*b*.

Figure 19:
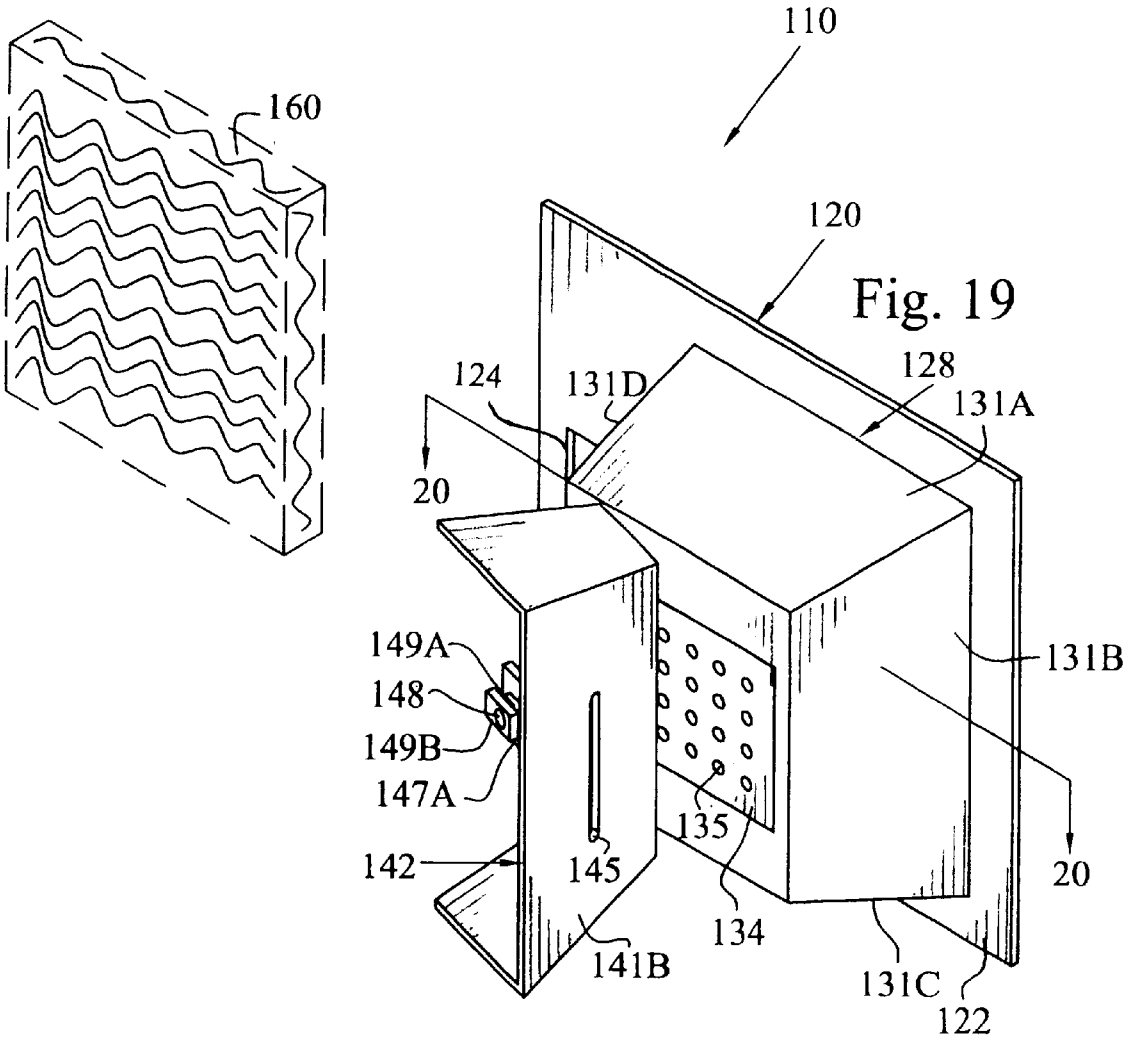
FIG. 19 is a perspective view of the security vent of FIG. 13, shown in an "open" position and shown with an air filter in spaced relation thereto.

The door assembly 140 is hingedly connected to the housing assembly 120 by the hinge 150 and is moveable between the "closed" position, such as shown in FIG. 15, and an "open" position, such as shown in FIG. 19. More particularly, the door bracket 152 is fixedly secured, such as, for example, by welding, to a rearwardly-facing surface of the door front face 143 such that the bracket key hole 158 is aligned with the key hole 144. The housing bracket 154 is fixedly secured, such as, for example, by welding, to a rearwardly-facing surface of the housing wall front face 130. The weld holes 152*a*, 154*a* permit secured welded attachment of the brackets 152, 154 to the door 142 and to the housing wall 128, respectively. The respective pin-receiving portions 152*a*, 154*a* are engaged with one another and the pin 156 is slidingly received therethrough to hingedly connect the brackets 152, 154 to one another. The pin 156 is received by the pin-receiving portions 152*a*, 154*a* to permit relative rotational hand movement of the brackets 152, 154, but with sufficient friction to prevent removal of the pin 156 therefrom without significant force or without special tools. Alternatively, the pin 156 may be tack-welded to a portion of either of the pin-receiving portions 152*a*, 154*a* to prevent removal of the pin 156 therefrom altogether.

Figure 16:
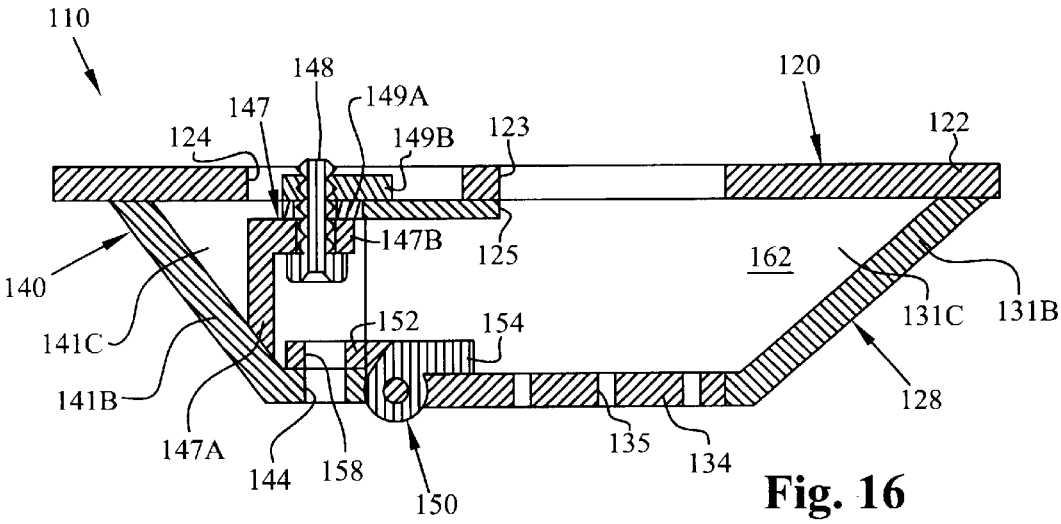
FIG. 16 is a section view of the security vent of FIG. 15, shown along section line 16—16 of FIG. 15.
Figure 17:
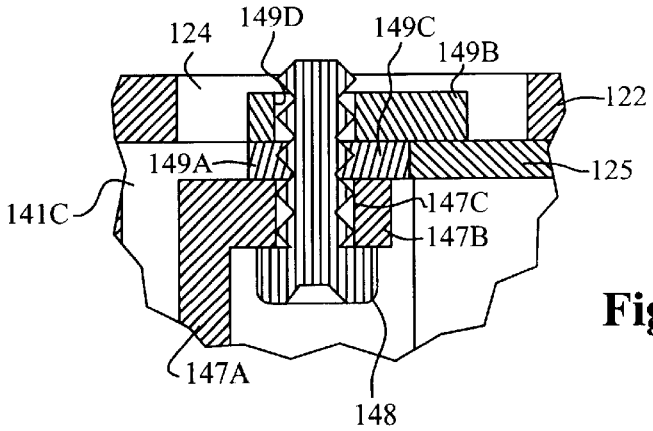
FIG. 17 is a section view of a latch assembly of the security vent of FIG. 16, shown in a "locked" position.
Figure 18:
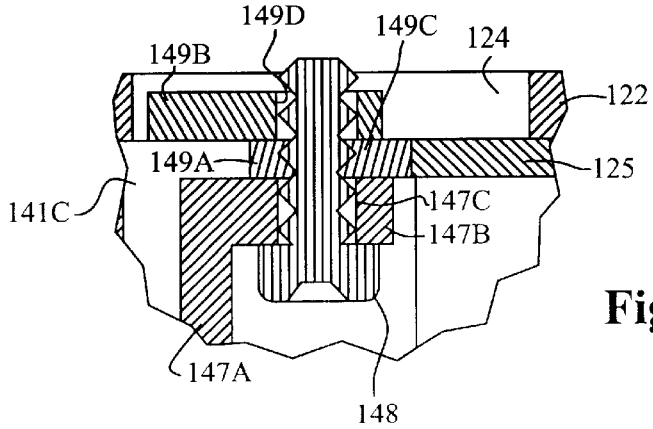
FIG. 18 is a section view of the latch assembly of FIG. 16, shown in an "unlocked" position.

With additional reference to FIGS. 16–18, the latch assembly 146 includes an angled mount bracket 147 having a forwardly-projecting portion 147*a* fixedly secured, such as, for example, by welding, to the rearwardly-facing surface of the door 142 within the slot 145. A transverse portion 147*b* of the mount bracket 147 includes a bore 147*c* sized to slidingly receive a tightening bolt 148 therethrough. A lock block 149*a* and a latch 149*b* are fixedly secured to one another, such as, for example, by welding, to form a latch weldment rotatably moveable between a "locked" position, such as shown in FIG. 17, and an "unlocked" position, such as shown in FIG. 18. The lock block 149*a* includes a threaded hole 149*c* to engage the tightening bolt 148. The latch 149*b* includes a bore 149*d* sized to slidingly receive the tightening bolt 148. The block hole 149*c* and the latch bore 149*d* are coaxial. The threads of the lock block 149*a* and of the tightening bolt 148 are designed such that relative rotation therebetween requires a large torque. As such, the tightening bolt 148 cannot be threadingly removed from the lock block 149*a* by hand rotation thereof and rotation of the tightening bolt 148 causes equivalent rotation of the latch weldment unless the latch weldment is held firmly in a stationary position, such as, for example, by a wrench or pliers.

More particularly, the tightening bolt 148 is threadingly engaged with the threaded hole 149*c* of the lock block 149*a* such that the transverse portion 147*b* of the mount bracket 147 is positioned between a head portion of the tightening bolt 148 and the lock block 149*a*, and such that the lock block 149*a* is positioned between the transverse portion 147*b* of the mount bracket 147 and the latch 149*b*. The latch assembly 146 is fixedly secured to the door 142 such that the tightening bolt 148 is rotatable about an axis "C" which is coincident with an axis of the door key hole 144. The transverse portion bore 147*c*, the lock block threaded hole 149*c* and the latch bore 149*d* are each coaxial with axis "C". The forwardly-projecting portion 147*a* of the mount bracket 147 is translationally positioned within the slot 145 such that the tightening bolt head portion is spaced rearwardly from the door key hole 144 by a distance sufficient to prevent access to the latch assembly 146 without a properly-sized key. The head portion of the tightening bolt 148 is provided with a hexagonal or other similarly-shaped recess, which requires a key having a similar size, shape and geometry to rotate same. Accordingly, unwanted rotation of the latch 149*b* into the "unlocked" position, without the key, is prevented thereby.

The security vent 110 is mountable to an existing wall defining an enclosed region of a building adjacent an inlet end of a return air duct disposed therebehind which is connected to a heating, ventilating and air-conditioning system to remove air from the enclosed region thereby. For example, where an existing inlet opening provided in an inmate cell of a penal institution comprises a perforated metal plate integrally-formed in a concrete cell wall, an opening is cut through the perforated metal plate by any suitable process, such as, for example, by a cutting torch. A rearwardly-facing surface of the mounting frame 122 is fixedly secured, such as, for example, by welding, to the existing metal plate such that the mounting frame opening 123 and the housing wall opening 129 are substantially aligned with the opening cut through the existing metal plate. A plurality of holes, slots or grooves may be provided through the mounting frame 122 to securely affix the mounting frame 122 to the existing metal plate. Alternatively, the mounting frame be affixed to the metal plate by any suitable, conventional means, such as, for example, by lock bolts or the like.

Figure 20:
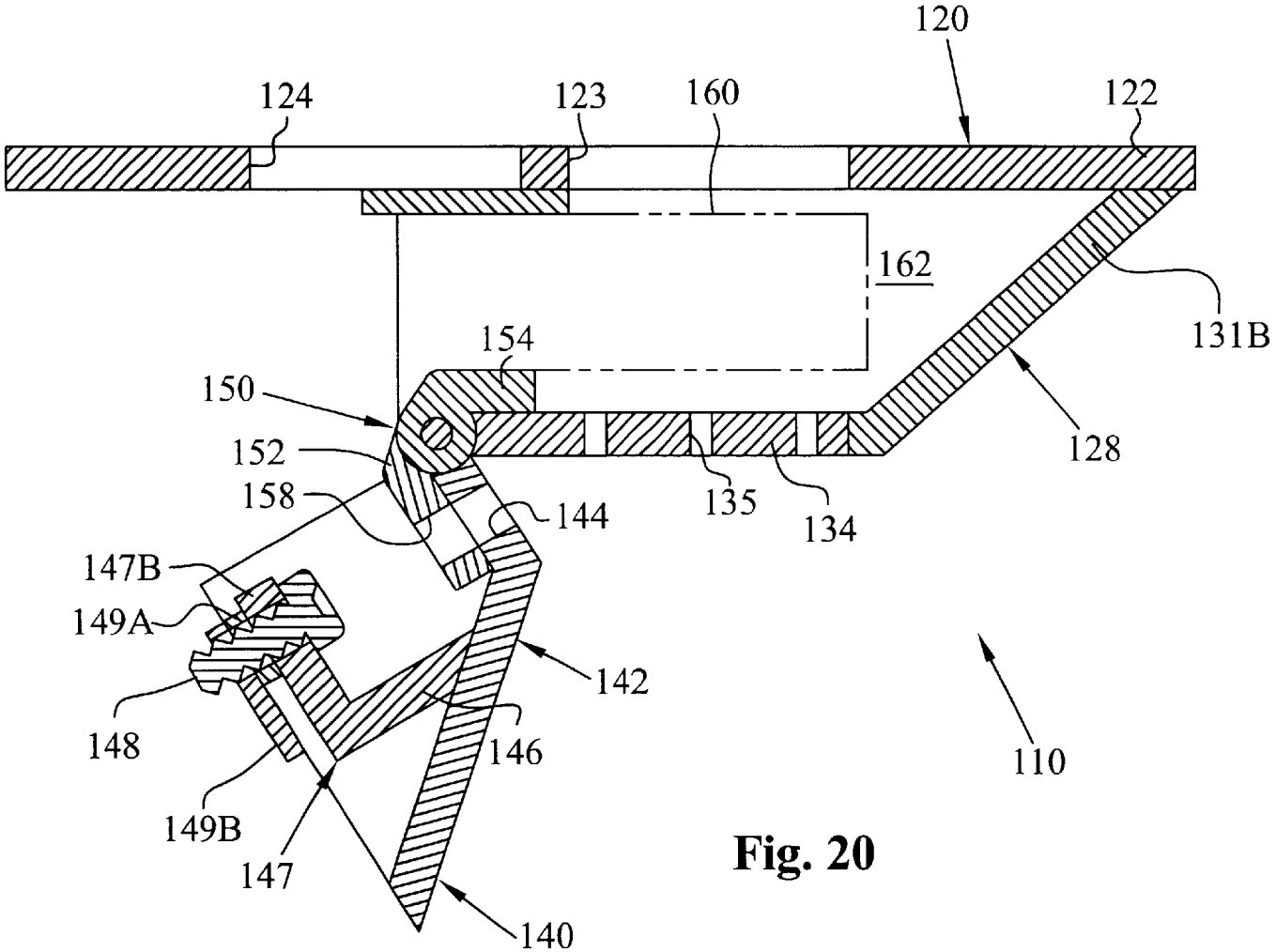
FIG. 20 is a section view of the security vent of FIG. 15, shown along section line 20—20 of FIG. 19 and shown with an air filter inserted therein.

With additional reference to FIGS. 19 and 20, the filter-receiving region 162 is accessible through the left side of the security vent 110 by unlocking the latch 149*b* as described hereinbelow and pivoting the door assembly 140 about the hinge 150 into the "open" position. A filter 160, preferably constructed from fiberglass or the like, is slidingly received within the filter-receiving region 162 and is sized to be held firmly therein during operation. The mounting frame opening 123, the filter 160 and the housing face orifices 135 permit air to flow therethrough into the air duct therebehind with only nominal static pressure being developed within the air duct behind the filter 160.

Once the filter 160 has been inserted into the filter-receiving region 162, the door assembly 140 is pivoted into the "closed" position, wherein the latch 149*b* is received by the aperture 124 rearward of the latch stop 125. The tightening bolt 148 is then rotated in a clockwise direction which causes the latch 149*b* to rotate clockwise due to the tight threaded fit between the tightening bolt 148 and the lock block 149*a*. Rotation of the tightening bolt 148 (and the latch 149*b*) continues until the latch 149*b* is seated behind the latch stop 125 in the "locked" position, at which point a first side edge of the latch 149*b* abuts an upwardly-facing edge of the aperture 124, thereby preventing further rotation of the latch 149*b*.

Additional rotation of the tightening bolt 148, however, further threads the lock block 149*a* thereon, causing the lock block 149*a* to move forwardly along the tightening bolt 148, pinching the transverse portion 147*b* of the mount bracket 147 between the lock block 149*a* and the head portion of the tightening bolt 148, thereby preventing counter-clockwise rotation of the tightening bolt 148 (and the latch 149*b*) without applying a substantially large counter-clockwise torque thereto. Because the head portion of the tightening bolt 148 is spaced rearwardly from the key hole 144, counter-clockwise rotation of the latch 149*b* from the "locked" position is prevented without a key.

The latch 149*b* is moveable into the "unlocked" position by applying sufficient counter-clockwise torque to the tightening bolt 148 to relieve the frictional pinch of the transverse portion 147*b* of the mount bracket 147 between the lock block 149*a* and the head portion of the tightening bolt 148. Once sufficient counter-clockwise torque is applied, the latch 149*b* rotates in a counter-clockwise direction due to the tight threaded fit between the tightening bolt 148 and the lock block 149*a*, until a second side edge of the latch 149*b* abuts the upwardly-facing edge of the aperture 124, at which point the latch 149*b* is clear of the latch stop 125 and may be forwardly removed from within the aperture 124 by pivoting the door assembly 140 into the "open" position.

Because the door assembly 140 permits only enough access to the filter-receiving region 162 to receive a filter 160 therein, access to the air duct by an individual of even very small proportions is prevented. Accordingly, even if an individual successfully unlocks the security vent 110 and opens the door assembly 140, gaining access to the filter-receiving region 162 therein, escape from the enclosed region therethrough is prevented.

The security vent 110 may be provided in numerous sizes, and in a number of preselected "standard" sizes which best fit existing air vents having varying sizes. That is, the security vent 110 may be slightly "oversized" with respect to an existing air vent to which the security vent 110 is desired to be attached, in that the mounting frame 122 simply fits over the face of an existing metal plate. Accordingly, the security vent 110 according to the present invention is readily mountable to numerous existing air vents heretofore provided in secure, as well as in non-secure, facilities.

Figure 21:
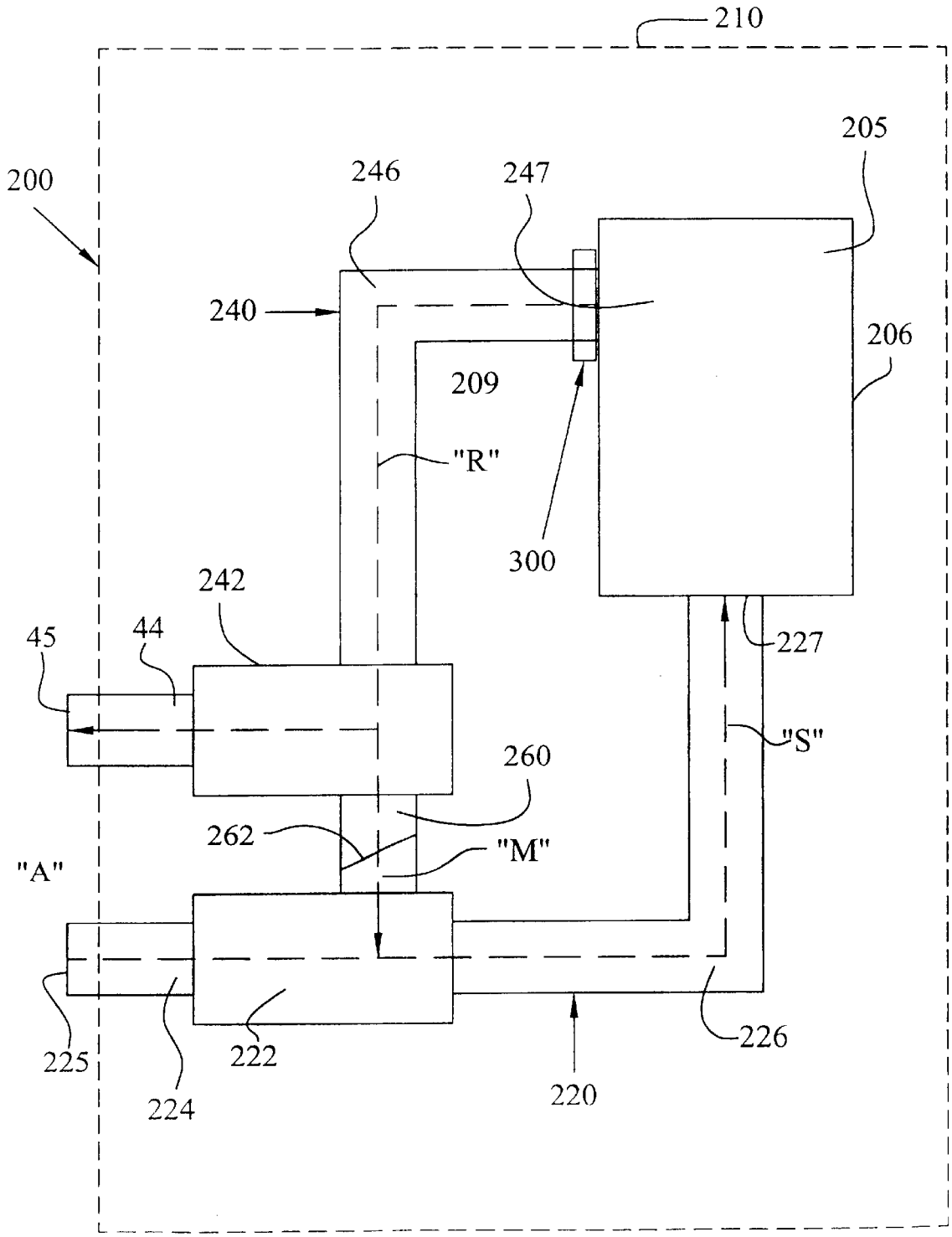
FIG. 21 is a schematic diagram of a system for ventilating a secure facility according to another embodiment of the present invention.

With reference to FIG. 21, a system 200 for ventilating an enclosed region 205 of a secure facility 210 is shown schematically and includes a supply side 220 and a return side 240. The secure facility 210 is, for example, a penal institution, mental hospital or any other facility having regulated, secure access thereto, such as a governmental facility or corporate office building. The enclosed region 205 is, for example, an inmate cell within a prison, a patient room within a mental hospital, or any other room, office or chamber having regulated, secure access thereto. The enclosed region 205 is preferably one of a plurality of enclosed regions located within the facility 210 and is enclosed by side walls 206.

The supply side 220 includes a supply side air handling unit 222, an intake 224 having an inlet end 225 open to the ambient "A", which surrounds the facility 210, and a supply side duct 226 having an outlet end 227 open to the enclosed region 205 and being in air-flow communication with the ambient "A" through the intake 224, the supply side air handling unit 222 and the supply side duct 226, sequentially. The supply side air handling unit 222 is preferably a conventional axial-blow fan capable of developing a static pressure within the supply side duct 226 suitable to draw fresh air in from the ambient "A" and to force the fresh air through the supply side duct 226 and into the enclosed region 205 through a vent (not shown) integrally-formed with the side wall 206. A fan motor (not shown) and power source (not shown) are electrically connected to the supply side air handling unit 222 such that the fresh air will flow through the supply side 220 at a desirable flow rate in a direction generally indicated in FIG. 21 by reference numeral "S".

The return side 240 includes a return side air handling unit 242, a discharge 244 having an outlet end 245 open to the ambient "A", and a return side duct 246 having an inlet end 247 open to the enclosed region 205 and being in air-flow communication with the ambient "A" through the return side duct 246, the return side air handling unit 242 and the discharge 244, sequentially. The return side air handling unit 242 is preferably a conventional axial-blow fan capable of developing a static vacuum within the return side duct 246 suitable to remove stale air from within the enclosed region 205, and to force the stale air through the return side duct 246 and expel the stale air therefrom through the outlet end 245 of the discharge 244. A fan motor (not shown) and power source (not shown) are electrically connected to the return side air handling unit 242 such that air will flow through the return side 240 at a desirable flow rate in a direction generally indicated in FIG. 21 by reference numeral "R".

Alternatively, a bypass duct 260 may be in air-flow communication between the supply side air handling unit 222 and the return side air handling unit 242 to permit re-circulation of return air through the bypass duct 260 along a bypass path generally indicated in FIG. 21 by reference numeral "M". A damper 262 may be provided within the bypass duct to regulate the flow of return air and the mix of return air with fresh air in the supply side air handling unit 222. Alternatively still, a combined air handling unit (not shown) may be used in lieu of separate supply side and return side air handling units 222, 242, respectively, in which case, the combined air handling unit would include an air-flow regulating system to mix re-circulated return air with fresh air.

Figure 22:
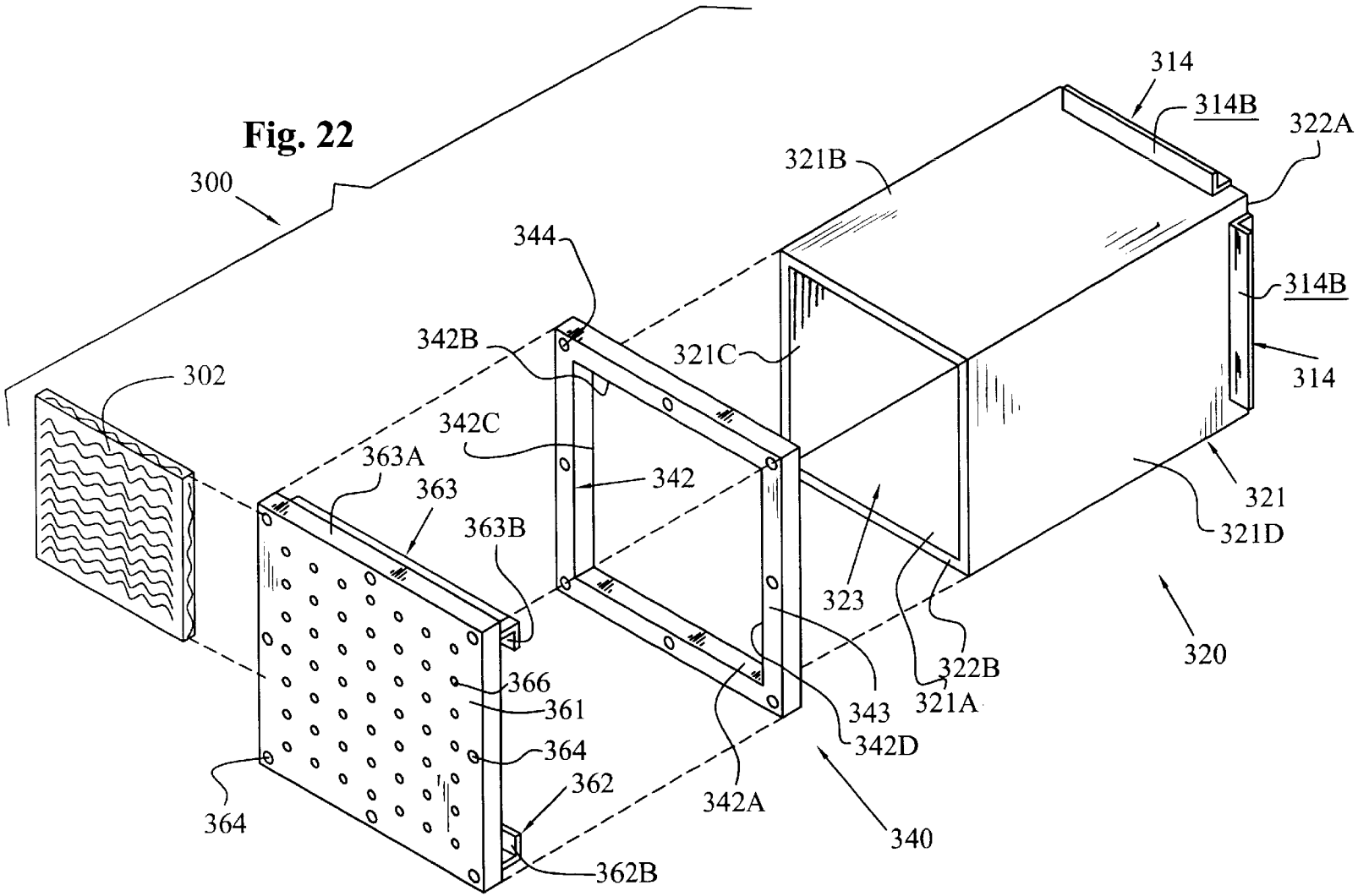
FIG. 22 is an exploded perspective view of an apparatus for filtering air in a secure facility according to another embodiment of the present invention.
Figure 26:
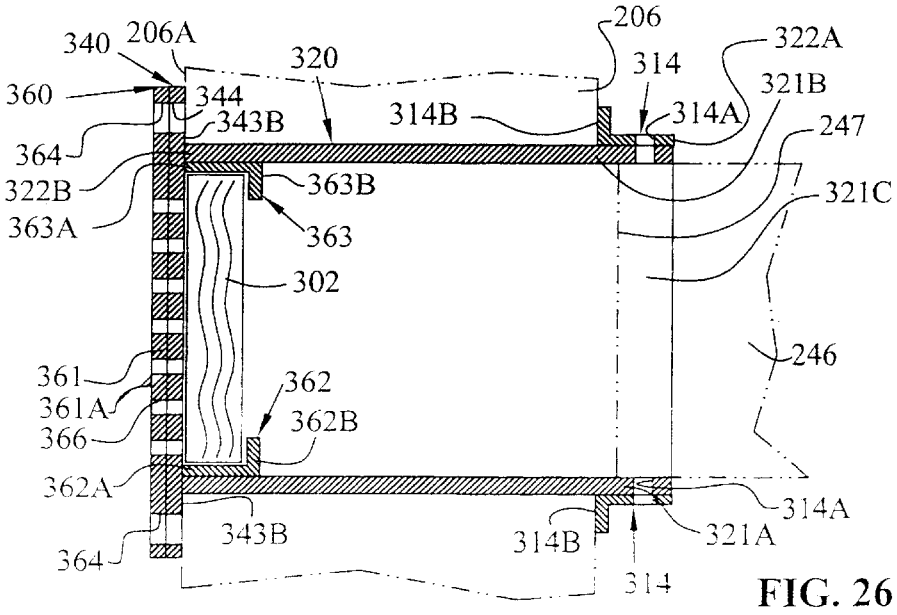
FIG. 26 is a section view of the assembled apparatus of FIG. 25, shown along section line 26—26 of FIG. 25.

With reference to FIGS. 21, 22 and 26, the ventilation system 200 includes a secure return side vent unit 300, which is securely connected to the inlet end 247 of the return side duct 246 and to the side wall 206 such that access to the return side duct 246 is restricted thereby. A filter 302 is receivable by the vent 300 and is removable therefrom for cleaning and replacement by maintenance personnel.

The vent 300 includes an outer housing 320, a face plate 340 and an access door 360, each of which is preferably constructed out of malleable hot-rolled steel or other similar rigid material having mechanical properties of steel. The outer housing 320 includes a substantially box-shaped side wall 321 having first and second open distal ends 322*a*, 322*b*, respectively, defining a passageway 323 therethrough. The side wall 321 includes first and second horizontal wall portions 321*a*, 321*b*, respectively, being in spaced parallel relation to one another, and first and second vertical wall portions 321*c*, 321*d*, respectively, being in spaced parallel relation to one another. Respective first and second longitudinal side edges of the horizontal wall portions 321*a*, 321*b* are integrally-formed with, or otherwise fixedly secured, for example, by welding, to upper and lower longitudinal edges of the vertical wall portions 321*c*, 321*d*, thereby forming the preferred box-shaped construction of the outer housing 320. The side wall 321 is sized and shaped to permit sliding engagement of the inlet end 247 of the return side duct 246 therein, wherein the first distal end 322*a* of the outer housing 320 is fixedly securable, such as, for example, by welding, to the inlet end 247 of the return side duct 246.

Figure 24:
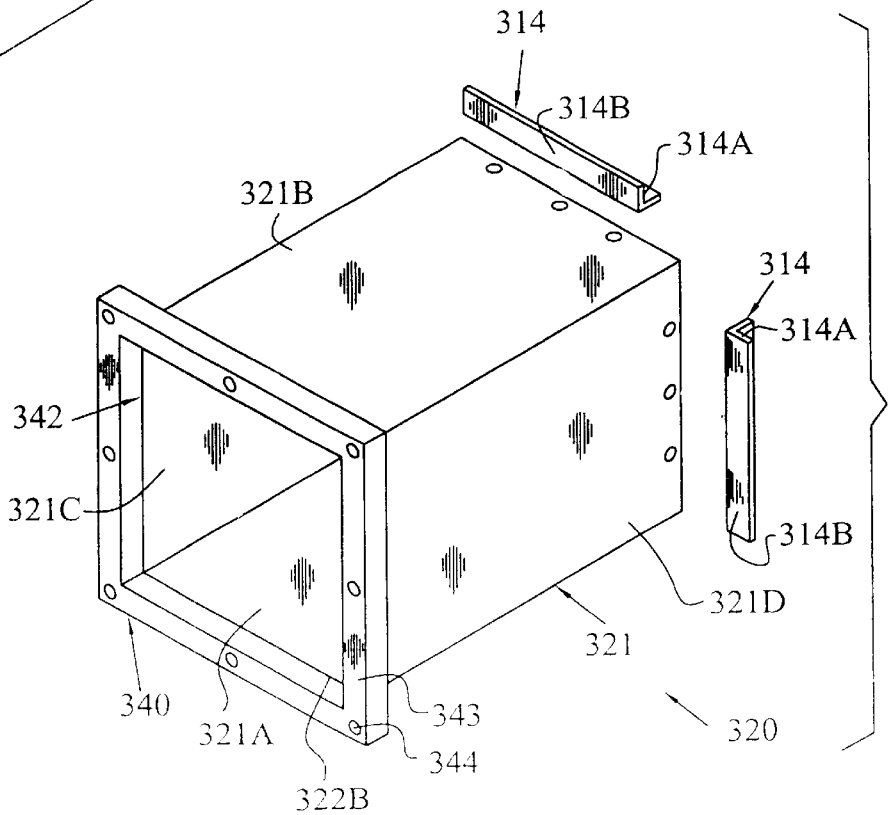
FIG. 24 is a front perspective view of an assembled outer housing of the apparatus of FIG. 22, shown prior to the access door of FIG. 23 being affixed thereto.

With additional reference to FIG. 24, the face plate 340 is shaped substantially like a picture frame and is fixedly secured, for example, by welding, to the second distal end 322*b* of the outer housing 320. The face plate 340 includes an opening 342 therethrough having a perimeter being substantially coextensive with an inner perimeter of the passageway 323. More particularly, the opening 342 includes a lower transverse edge 342*a* which is flush with the inner surface of the first horizontal side wall portion 321*a*, an upper transverse edge 342*b* which is flush with the inner surface of the second horizontal side wall portion 321*b*, a left edge 342*c* which is flush with the inner surface of the first vertical side wall portion 321*c* and a right edge 342*d* which is flush with the inner surface of the second vertical side wall portion 321*d*. The outer perimeter of the face plate 340 is greater than the outer perimeter of the housing portion side wall 321, thereby defining a retaining lip 343 therearound. One or more throughbores 344 are provided through the retaining lip 343 and are spaced equidistantly therearound. Preferably, eight throughbores 344 are provided, one of four throughbores 344 being located near each corner of the retaining lip 343 and one of four throughbores 344 being spaced between each adjacent comer of the retaining lip 343. The throughbores 344 may be threaded to receive a conventional penal bolt, security bolt or other conventional lock-type bolt 304.

At least one flange 314, such as, for example, an "L"-shaped angle beam segment, is removably secured, such as, for example, by bolting, to at least one of the side wall portions 321*a*, 321*b*, 321*c*, 321*d*, near the first distal end 322*a* of the outer housing 320 a preselected distance therefrom towards the second distal end 322*b* of the outer housing 320. Preferably, one flange 314 is fixedly secured to each of the side wall portions 321*a*, 321*b*, 321*c*, 321*d*. Further, each flange 314, and its corresponding side wall portion 321*a*, 321*b*, 321*c*, 321*d*, includes at least one hole 314*a* therethrough for receiving a bolt (not shown) therethrough to secure the flange 314 to the side wall 321. Alternatively, the flange 314 may be welded directly to an outer surface of the wall portion 321*a*, 321*b*, 321*c*, 321*d*, in which case, the holes 314*a* are not provided.

An upright portion of the flange 314 defines a forwardly-facing surface 314*b* thereof which is in spaced relation to a rearwardly-facing surface 343*b* of the retaining lip 343 by a preselected distance, which typically corresponds to the thickness of the side wall 206 of the enclosed region 205. The upright portion of the flange 314 cooperates with the retaining lip 343 to sandwich a portion of the wall 206 therebetween, and to mount the vent 300 thereto as hereinbelow described.

Figure 23:
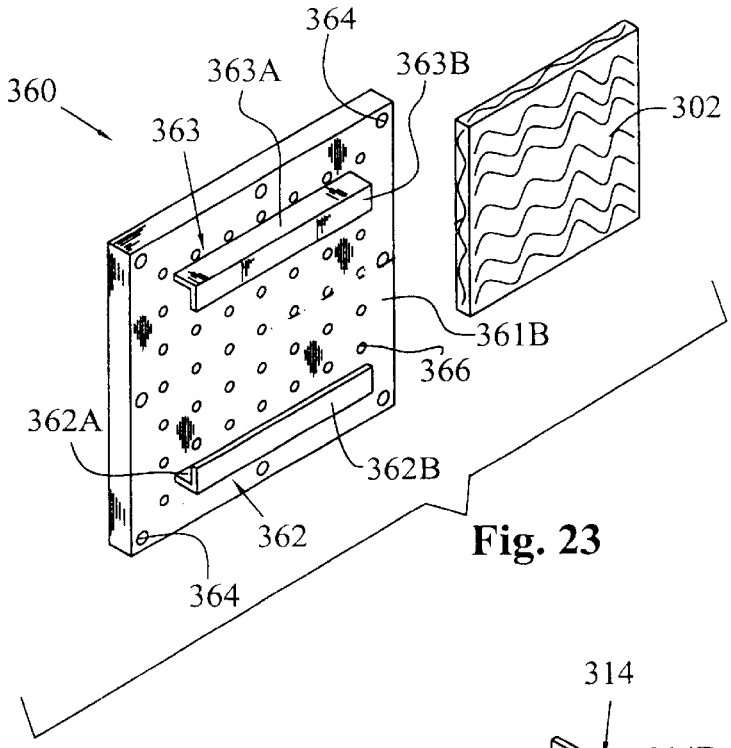
FIG. 23 is a rear perspective view of an access door of the apparatus of FIG. 22, shown having a replaceable filter being in spaced relation thereto.

With reference to FIGS. 22 and 23, the access door 360 includes a screen portion 361 having a plurality of vent holes 366 through a center region thereof to permit air-flow therethrough. The screen portion 361 is shaped substantially like the face plate 340 and is preferably coextensive with the outer perimeter of the face plate 340 such that the screen portion 361 covers the face plate 340 when the vent 300 is assembled as described below. The screen portion 361 includes one or more bolt holes 364 therethrough which are spaced equidistantly therearound. Preferably, eight bolt holes 364 are provided, one bolt hole 364 for each throughbore 344 of the face plate 340, and are positioned on the screen portion 361 such that the bolt holes 364 align with the throughbores 344 when the access door 360 is positioned over the face plate 340, as described below and as shown in FIG. 26. The plurality of vent holes 366 are located on the screen portion 361 to be over the opening 342 of the face plate 340 when the access door 360 is positioned over the face plate 340 as described below.

First and second filter-holding brackets 362, 363, respectively, are fixedly secured, for example, by welding, to a backside surface 361*b* of the screen portion 361 and are spaced from one another a sufficient distance to be received by the opening 342 of the face plate 340 between the first and second horizontal side wall portions 321*a*, 321*b*, respectively, of the outer housing side wall 321 when the access door 360 is positioned over the face plate 340 as described below. Preferably, the filter-holding brackets 362, 363 are "L"-shaped angle beam segments having a sufficient length to be received by the opening 342 of the face plate 340 between the first and second vertical side wall portions 321*c*, 321*d*, respectively, of the outer housing side wall 321 when the access door 360 is positioned over the face plate 340 as described below.

Each filter-holding bracket 362, 363 includes a horizontal portion 362*a*, 363*a*, respectively, and a vertical portion 362*b*, 363*b*. The horizontal portions 362*a*, 363*a*are vertically spaced from one another a sufficient distance to receive the filter 302 therebetween. The vertical portions 362*b*, 363*b* extend towards one another from their respective horizontal portions 362*a*, 363*a* and are spaced rearwardly from the backside surface 361*b* of the screen portion 361 thereby a sufficient distance to receive the filter 302 therebetween and to hold the filter 302 against the backside surface 361*b* of the screen portion 361.

Figure 25:
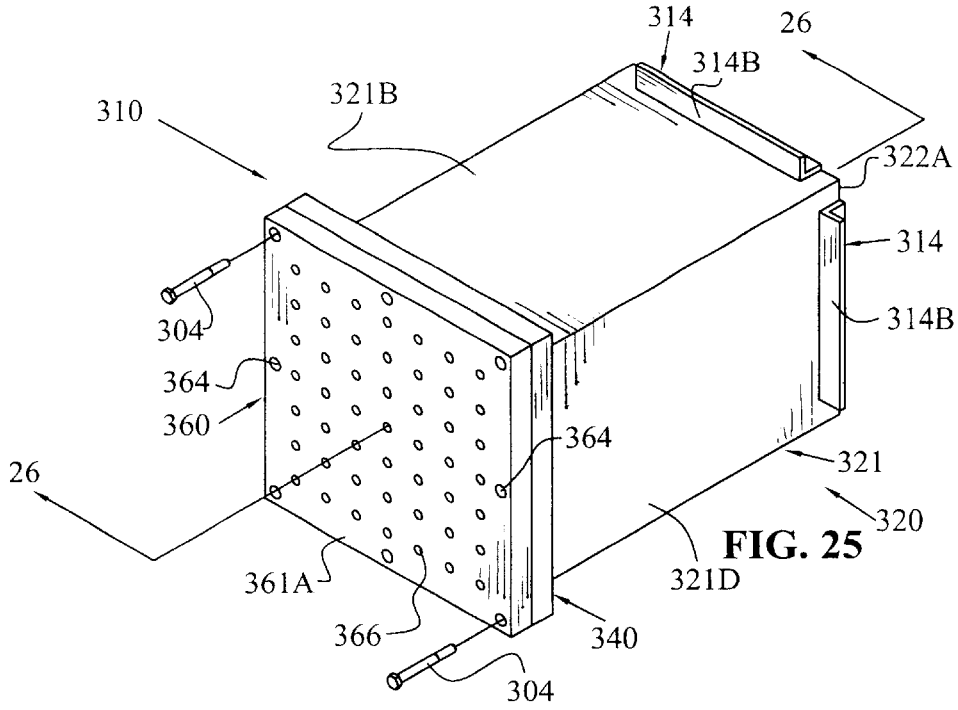
FIG. 25 is a front perspective view of the apparatus of FIG. 22, shown assembled and with the access door of FIG. 23 being affixed thereto.

With additional reference to FIGS. 24–26, the vent 300 is assembled and mounted to the wall 206 of an enclosed region 205 by sliding the outer housing 320 through a wall hole (not shown) in the wall 206 near the inlet end 247 of the return side duct 246, which is received by the first distal end 322*a* of the outer housing 320. The outer housing 320 is oriented such that the rearwardly-facing surface 343*b* of the retaining lip 343 abuts an interior surface 206*a* of the wall 206. A portion of the interior surface 206*a* of the wall 206 may be stepped in a region around the wall hole such that the frontside surface 361*a* of the access door 360 is flush with the interior surface 206*a* of the wall 206 when the vent 300 is fully-assembled and mounted.

Once the outer housing 320 is positioned within the wall hole (not shown), flanges 314 are positioned on the exterior surfaces of the outer housing side wall 321 to sandwich the wall 206 between the flanges 314 and the retaining lip 343 of the face plate 340. The flanges 314, then, are firmly secured to the outer housing side wall 321, which may be further fixedly secured, for example, by welding, directly to the return side duct 246.

The filter 302 is positioned over the backside surface 361*b* of the screen portion 361 to cover the plurality of vent holes 366. The access door 360 is then positioned over the face plate 340 such that the opening 342 of the face plate 340 receives the filter-holding brackets 362, 363 therein. Security bolts 304 are then used to securely fasten the access door 360 to the face plate 340 to prevent removal of the access door 360 from the face plate 340 without the appropriate tools.

Figure 27:
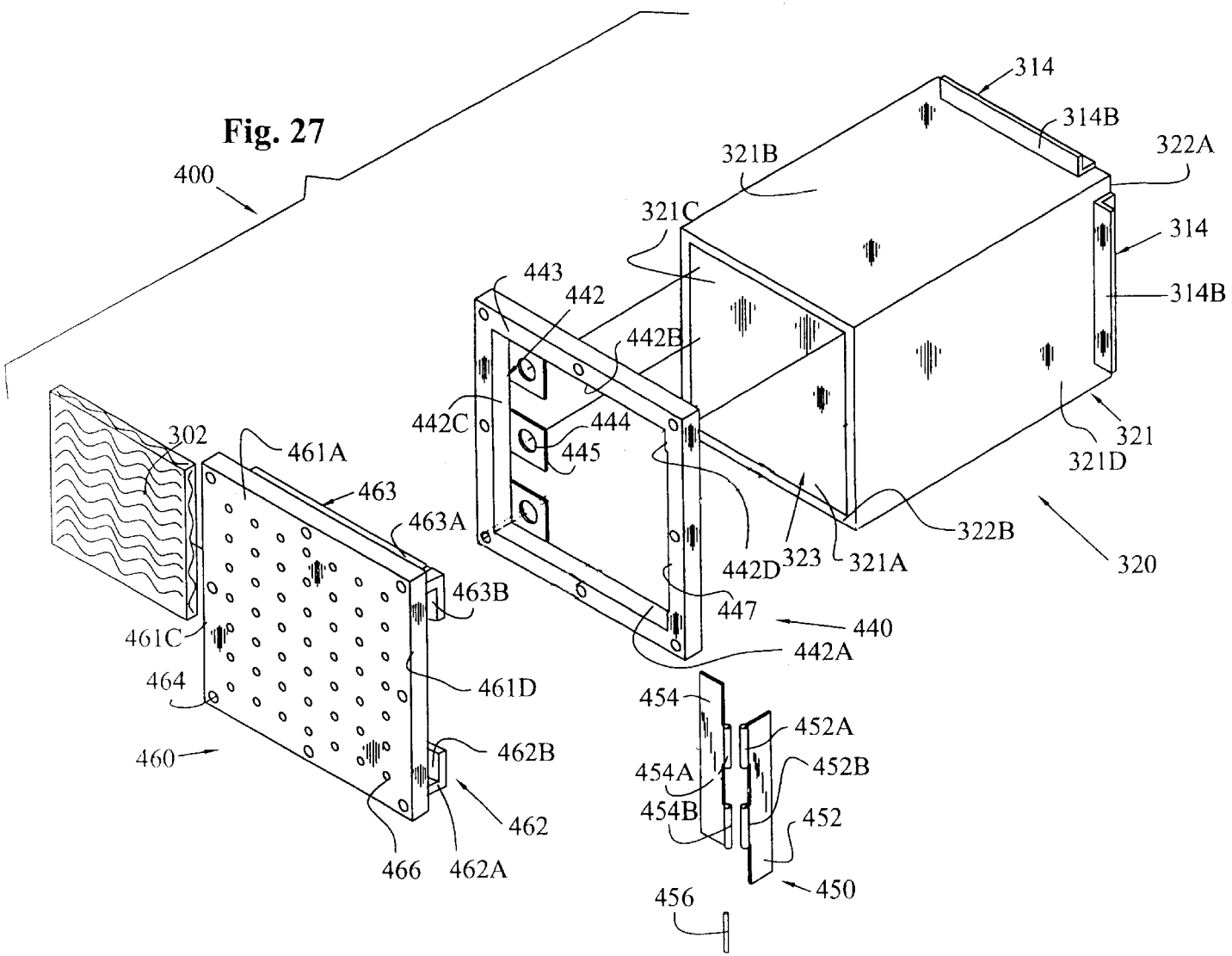
FIG. 27 is an exploded perspective view of an apparatus for filtering air in a secure facility according to another embodiment of the present invention.

With reference to FIGS. 27–29, a secure return side vent unit 400 according to an alternative embodiment of the present invention includes many components in common with the vent 300 according to the preferred embodiment hereof and like reference numerals are intended to represent like components. However, the vent 400 according to the present embodiment includes an access door 460 which is hingedly connected to the outer housing 320 of the preferred embodiment hereof, for example, by a conventional piano hinge 450.

More particularly, the vent 400 according to the present embodiment includes the outer housing 320 of the preferred embodiment hereof, a face plate 440 and an access door 460, each of which is preferably constructed out of malleable hot-rolled steel or other similar rigid material having mechanical properties of steel. The face plate 440 is shaped substantially like a picture frame and is fixedly secured, for example, by welding, to the second distal end 322*b* of the outer housing 320.

The face plate 440 includes an opening 442 therethrough having a perimeter being substantially coextensive with the perimeter of the passageway 323 through the housing portion 320. The opening 442 includes a lower transverse edge 442*a* which is flush with the inner surface of the first horizontal side wall portion 321*a*, an upper transverse edge 442*b* which is flush with the inner surface of the second horizontal side wall portion 321*b*, a left edge 442*c* which is flush with the inner surface of the first vertical side wall portion 321*c*and a right edge 442*d* which is spaced from the inner surface of the second vertical side wall portion 321*d* towards the first vertical side wall portion 321*c*. The right edge 442*d* of the opening 442 includes a stepped portion 447 which is flush with the inner surface of the second vertical side wall portion 321*d*. The outer perimeter of the face plate 440 is greater than the outer perimeter of the outer housing side wall 321, thereby defining a retaining lip 443 therearound.

One or more tabs 445 are fixedly secured, for example, by welding, to a backside surface (not shown) of the face plate 440 and extend partways over the opening 442 beyond the left edge 442*c* thereof. Each tab 445 includes a throughbore 444, which may be threaded to receive a conventional penal bolt, security bolt or other conventional lock-type bolt 304 therein. A first wing portion 452 of the hinge 450 is fixedly secured to the inner surface of the second vertical side wall portion 321*d* such that a discontinuous tubular projection 452*a*, 452*b* of the first wing portion 452 seats within the stepped portion 447 of the opening 442.

The access door 460 includes a screen portion 461 having one or more vent holes 466 through a center region thereof. The screen portion 461 is shaped to be coplanar with, and to fit within, the opening 442 of the face plate 440 when the access door 460 is in a "closed" position as described hereinabove and as shown generally in FIG. 29. The screen portion 461 includes one or more bolt holes 464 therethrough which are spaced along a left edge 461*c* thereof. A second wing portion 454 of the hinge 450 is fixedly secured, for example, by welding, to the backside surface (not shown) of the screen portion 461 along a right edge 461*d* thereof such that a discontinuous tubular portion 454*a*, 454*b* of the second wing portion 454 engages the discontinuous tubular portion 452*a*, 452*b* of the first wing portion 452 within the stepped portion 447 of the face plate opening 442. A pin 456 passes through both discontinuous tubular portions 452*a*, 452*b*, 454*a*, 454*b*, thereby locking the winged portions 452, 454 together and permitting relative pivolable movement therebetween.

The screen portion bolt holes 464 are located along the left edge 461*c* thereof such that, when the access door 460 is pivoted into the "closed" position, the bolt holes 464 are aligned with the tab throughbores 444, thereby permitting the access door 460 to be securely affixed to the housing portion 320 by one or more security bolts 304. Alternatively, a latch (not shown) may be rotatably affixed to the backside surface (not shown) of the access door 460 and which passes behind one or more of the tabs 445 when the access door 460 is in the "closed" position. The bolt hole 464, then, may be used to permit an unlocking key (not shown) to rotate the latch into either an engaged or a retracted position to permit opening of the access door 460 accordingly.

First and second filter-holding brackets 462, 463 are affixed to the backside surface (not shown) of the screen portion 461 as described hereinabove with reference to the preferred embodiment hereof. A filter 302 is positionable over the plurality of vent holes 466 thereby and removable therefrom when the access door 460 is in the "open" position, such as is shown in FIG. 28.

Figure 30:
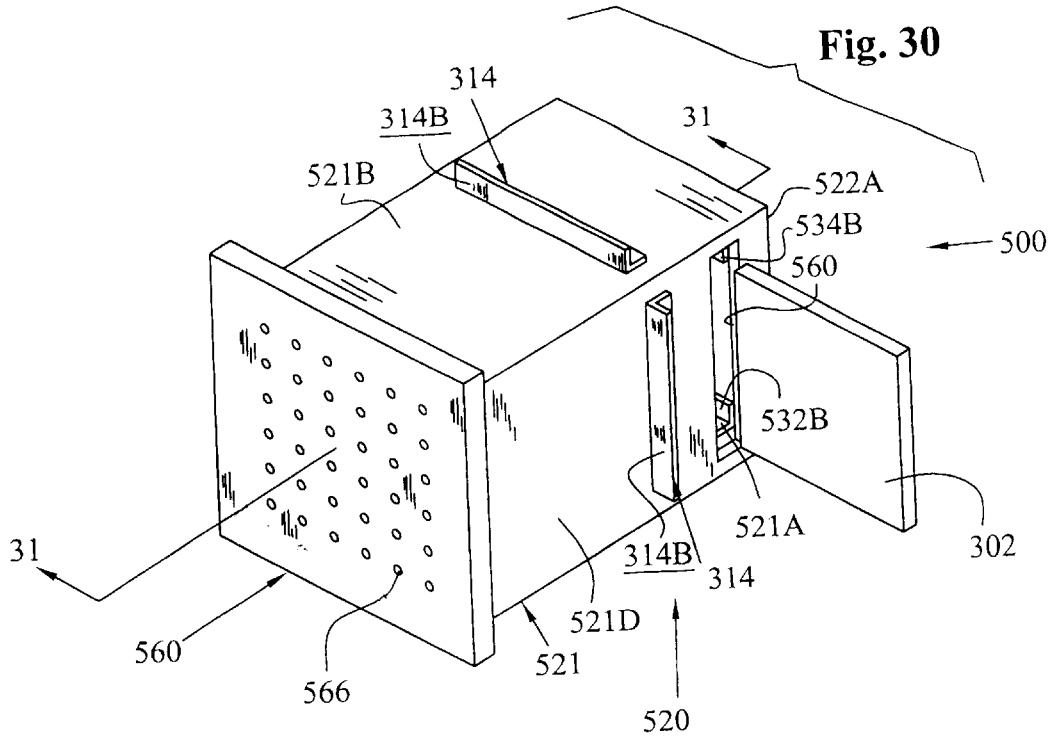
FIG. 30 is a front perspective view of an apparatus for filtering air in a secure facility according to another embodiment of the present invention, shown in spaced relation to a filter; and, FIG. 31 is a section view of the apparatus of FIG. 30, shown along section line 31—31 of FIG. 30.
Figure 31:
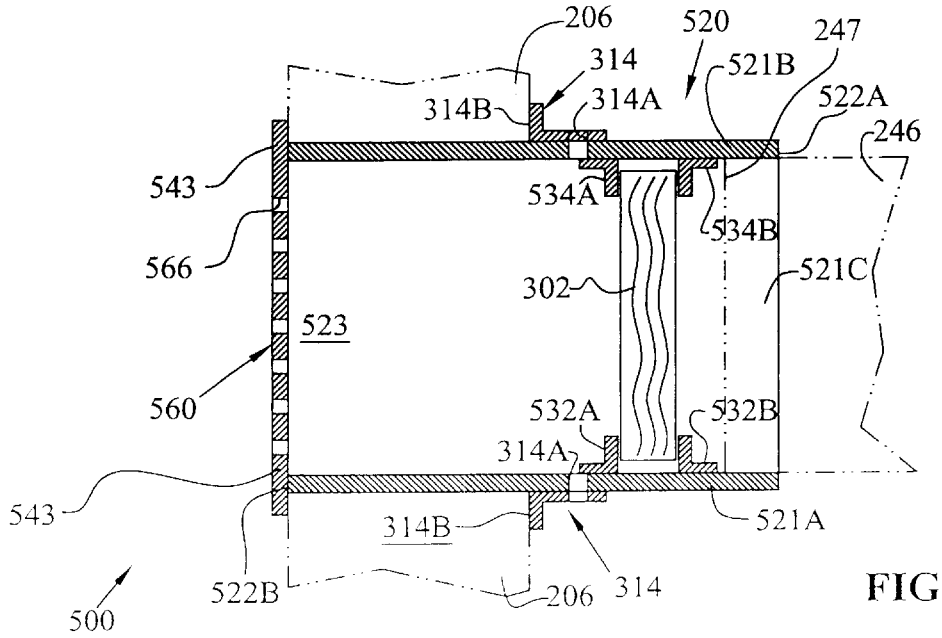

With reference to FIGS. 30 and 31, a secure return side vent unit 500 according to another alternative embodiment of the present invention includes many components in common with the vent 300 according to the preferred embodiment hereof and like reference numerals are intended to represent like components. More particularly, the vent 500 according to the present embodiment includes an outer housing 520 and a screen portion 560 fixedly secured, for example, by welding, to a second distal end 522*b* of the outer housing 520.

The outer housing 520 includes a substantially box-shaped side wall 521 having first and second distal ends 522*a*, 522*b*, respectively, defining a passageway 523 therethrough. The side wall 521 includes first and second horizontal wall portions 521*a*, 521*b*, respectively, being in spaced parallel relation to one another, and first and second vertical wall portions 521*c*, 521*d*, respectively, being in spaced parallel relation to one another. Respective first and second longitudinal side edges of the horizontal wall portions 521*a*, 521*b* are integrally-formed with, or otherwise fixedly secured, for example, by welding, to upper and lower longitudinal edges of the vertical wall portions 521*c*, 521*d*, thereby forming the preferred box-shaped construction of the outer housing 520. The side wall 521 is sized and shaped to permit sliding engagement of the inlet end 247 of the return side duct 246 therein as described hereinabove with respect to the preferred embodiment hereof.

A slot 560 is provided through one of the side wall portions 521*a*, 521*b*, 521*c*, 521*d* of the outer housing 520, and preferably, through the second vertical side wall portion 521*d* of the outer housing 520, near the first distal end 522*a* thereof. The slot 560 is sized to slidingly receive the filter 302 therethrough such that the filter 302 is thereby positionable within the passageway 523. First and second lower transverse filter guides 532*a*, 532*b* are fixedly secured, for example, by welding, to the inner surface of the first horizontal side wall portion 521*a* on opposing sides of the slot 560 and span the passageway 523 along the first horizontal side wall portion 521*a*. First and second upper transverse filter guides 534*a*, 534*b* are fixedly secured, for example, by welding, to the inner surface of the second horizontal side wall portion 521*b* on opposing sides of the slot 560 and span the passageway 523 along the second horizontal side wall portion 521*b*. The filter guides 532*a*, 532*b*, 534*a*, 534*b* are preferably constructed from "L"-shaped angle beam segments.

The lower filter guides 532*a*, 532*b* each have an upturned portion which cooperate with one another to define a lower filter-receiving channel therebetween. The upper filter guides 534*a*, 534*b* each have a downtumed portion which cooperate with one another to define an upper filter-receiving channel therebetween. The upper and lower filter-receiving channels cooperate to slidingly receive the filter 302 and to firmly hold the filter 302 in a substantially upright orientation spanning substantially the passageway 523. A door (not shown) may be provided over the slot 560 to prevent pressure loss.

The screen portion 560 is fixedly secured, for example, by welding, to the second distal end 522*b* of the housing portion 520. The outer perimeter of the screen portion 560 is greater than the outer perimeter of the outer housing side wall 521, thereby defining a retaining lip 543 therearound. A plurality of vent holes 566 are provided through the screen portion 560 to permit air-flow therethrough. Although the vent 500 according to the present embodiment is mounted to the wall 206 in the same manner in which the vent 300 according to the preferred embodiment hereof is mounted to the wall 206, removing and replacing the filter 302 from the vent 500 according to the present embodiment must be performed from the so-called "pipe chase" side 207 of the wall 206, that is, from the side of the wall exterior to the enclosed region 205.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

What is claimed is:

1. A vent, including:

a housing defining a passageway having first and second ends;

a door;

a filter located behind the door, the filter having a first surface facing the door, a second surface facing at least one end of the passageway, a first side, a second side, a top surface and a bottom surface;

first and second vertical filter retaining portions located adjacent the second surface of the filter;

a first horizontal filter retaining portion located above the top surface of the filter;

a second horizontal filter retaining portion located below the bottom surface of the filter; and at least two bolts securing the door to the housing, at least one of the bolts being located above the top surface of the filter and at least one of the bolts being located below the bottom surface of the filter.

2. A vent according to claim 1, wherein the first and second horizontal portions are connected to the door.

3. A vent according to claim 1, wherein the first vertical portion is connected to the first horizontal portion and the second vertical portion is connected to the second horizontal portion.

4. A vent according to claim 1, wherein the first and second horizontal portions are located within the passageway.

5. A vent according to claim 1, wherein the first and second vertical portions are located within the passageway.

6. A vent, including:

a housing having a pair of spaced-apart, horizontal wall portions joined to a pair of spaced-apart, vertical wall portions so as to define a passageway having first and second ends;

a door adjacent one of the ends of the passageway;

a filter disposed within the passageway;

a first bracket secured to the door, the first bracket including a horizontal portion located above the filter; and a second bracket secured to the door, the second bracket including a horizontal portion located below the filter.

7. A vent according to claim 6, wherein the first bracket includes a first vertical portion connected to the horizontal portion of the first bracket and the second bracket includes a second vertical portion connected to the horizontal portion of the second bracket.

8. A vent according to claim 6, wherein the first and second vertical portions extend toward each other.

9. A vent according to claim 6, wherein the door is located on one side of the filter and the first and second vertical portions are located on the side of the filter opposite the door.

10. A vent according to claim 6, wherein the horizontal portion of at least one of the brackets is located within the passageway.

11. A vent according to claim 6, wherein the first and second brackets are located within the passageway.

12. A vent according to claim 6, wherein the vertical portion of at least one of the brackets is located within the passageway.

13. A vent according to claim 6, wherein the horizontal portion of the first bracket is located adjacent one of the horizontal wall portions of the housing.

14. A vent according to claim 6, further including at least one bolt for securing the door in a closed position.

15. A vent according to claim 1, further including a hinge securing the door to the housing.

16. A vent according to claim 15, further including at least one bolt for securing the door in a closed position.

17. A vent according to claim 6, further including a least one tab located near one of the ends of the passageway, the tab including an opening for receiving a portion of the bolt when the door is secured in a closed position.

18. A vent according to claim 6, further including a hinge securing the door to the housing.

* * * * *

UNITED STATES PATENT AND TRADEMARK OFFICE

CERTIFICATE OF CORRECTION

PATENT NO. : 6,371,846 B1
DATED : April 16, 2002
INVENTOR(S) : Robert A. Powell and Richard W. Stephens It is certified that error appears in the above-identified patent and that said Letters Patent is hereby corrected as shown below:

Column 24,
Line 15, delete second "a" and insert -- at --

Signed and Sealed this

Eleventh Day of June, 2002

*Attest:*

*Attesting Officer*

JAMES E. ROGAN
*Director of the United States Patent and Trademark Office*